US009158228B2

(12) United States Patent
Ogawa et al.

(10) Patent No.: US 9,158,228 B2
(45) Date of Patent: Oct. 13, 2015

(54) DEVELOPMENT DEVICE AND IMAGE FORMING APPARATUS INCORPORATING SAME

(75) Inventors: Yoshiko Ogawa, Tokyo (JP); Osamu Endou, Kanagawa (JP); Yasuyuki Ishii, Tokyo (JP); Yuuji Ishikura, Kanagawa (JP); Hideyasu Seki, Kanagawa (JP); Tetsuro Hirota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 13/608,240

(22) Filed: Sep. 10, 2012

(65) Prior Publication Data

US 2013/0071147 A1 Mar. 21, 2013

(30) Foreign Application Priority Data

| | | |
|---|---|---|
| Sep. 16, 2011 | (JP) | 2011-203745 |
| Nov. 28, 2011 | (JP) | 2011-259439 |
| Jul. 20, 2012 | (JP) | 2012-162000 |
| Jul. 20, 2012 | (JP) | 2012-162004 |

(51) Int. Cl.
*G03G 15/08* (2006.01)

(52) U.S. Cl.
CPC ..... *G03G 15/0812* (2013.01); *G03G 15/0808* (2013.01); *G03G 15/0818* (2013.01)

(58) Field of Classification Search
CPC ..... G03G 15/0808; G03G 15/0812; G03G 15/0818
USPC ..... 399/264, 265, 273, 274, 279, 283–286
See application file for complete search history.

(56) References Cited

U.S. PATENT DOCUMENTS

| | | | | |
|---|---|---|---|---|
| 4,755,847 | A * | 7/1988 | Matsushiro et al. | 399/284 |
| 4,866,480 | A * | 9/1989 | Hosoya et al. | 399/281 |
| 5,548,382 | A * | 8/1996 | Koshi et al. | 399/274 |
| 2006/0099011 | A1 * | 5/2006 | Kamijo et al. | 399/239 |
| 2009/0123193 | A1 | 5/2009 | Kosugi et al. | |
| 2009/0148197 | A1 * | 6/2009 | Yamada et al. | 399/284 |
| 2009/0176171 | A1 | 7/2009 | Ogawa et al. | |
| 2009/0245822 | A1 | 10/2009 | Nagatsuka et al. | |
| 2009/0257786 | A1 | 10/2009 | Nakagawa et al. | |
| 2009/0257791 | A1 | 10/2009 | Nakagawa et al. | |
| 2009/0274485 | A1 | 11/2009 | Adachi et al. | |
| 2009/0290901 | A1 | 11/2009 | Ishii et al. | |
| 2010/0003058 | A1 | 1/2010 | Hori et al. | |
| 2010/0021214 | A1 | 1/2010 | Kadota et al. | |
| 2010/0104319 | A1 | 4/2010 | Saitoh et al. | |
| 2010/0150615 | A1 | 6/2010 | Nakagawa et al. | |

(Continued)

FOREIGN PATENT DOCUMENTS

| | | |
|---|---|---|
| JP | 4-000470 | 1/1992 |
| JP | 2002-258602 | 9/2002 |

(Continued)

*Primary Examiner* — Ryan Walsh
(74) *Attorney, Agent, or Firm* — Oblon, McClelland, Maier & Neustadt, L.L.P.

(57) ABSTRACT

A development device includes a developer bearer to carry by rotation developer to a development range facing a latent image bearer, and a planar metal developer regulator to adjust an amount of developer carried by the developer bearer to the development range. The developer bearer includes a developer carrying range having surface unevenness, and the developer regulator includes a fixed end portion held by a regulator holder and a free end portion to contact a surface of the developer bearer.

15 Claims, 28 Drawing Sheets

(56) References Cited

U.S. PATENT DOCUMENTS

| | | | | |
|---|---|---|---|---|
| 2010/0183342 | A1 | 7/2010 | Saitoh et al. | |
| 2010/0214364 | A1 | 8/2010 | Hirota et al. | |
| 2010/0239327 | A1* | 9/2010 | Yamada et al. | 399/284 |
| 2011/0043589 | A1 | 2/2011 | Hirota et al. | |
| 2011/0064432 | A1 | 3/2011 | Horike et al. | |
| 2011/0164892 | A1 | 7/2011 | Ogawa et al. | |
| 2011/0182626 | A1 | 7/2011 | Hirota et al. | |
| 2011/0229232 | A1 | 9/2011 | Kojima et al. | |
| 2012/0057891 | A1 | 3/2012 | Ishikura et al. | |
| 2012/0063797 | A1 | 3/2012 | Hirota et al. | |
| 2012/0063815 | A1 | 3/2012 | Seki et al. | |
| 2013/0071148 | A1 | 3/2013 | Ishikura et al. | |

FOREIGN PATENT DOCUMENTS

| | | |
|---|---|---|
| JP | 2003-263018 | 9/2003 |
| JP | 2007-121951 | 5/2007 |
| JP | 2007-178901 | 7/2007 |
| JP | 2008-197692 | 8/2008 |
| JP | 2009-031522 | 2/2009 |
| JP | 2010-033003 | 2/2010 |
| JP | 2010-152070 | 7/2010 |

* cited by examiner

DEVELOPMENT DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2011-203745 filed on Sep. 16, 2011, 2011-259439 filed on Nov. 28, 2011, 2012-162000 filed on Jul. 20, 2012, and 2012-162004 filed on Jul. 20, 2012, in the Japan Patent Office, the entire disclosure of each of which is hereby incorporated by reference herein.

FIELD OF THE INVENTION

The present invention generally relates to a development device and an image forming apparatus, such as a copier, a printer, a facsimile machine, or a multifunction machine having at least two of these capabilities, that includes a development device.

BACKGROUND OF THE INVENTION

Development devices that include a development roller having surface unevenness are known. For example, JP-2007-178901-A and JP-2007-121951-A propose forming projections having a substantially identical height and recesses having a substantially identical depth regularly in the surface of the development roller and disposing rubber developer regulators (i.e., doctor blades) are disposed in contact with the development roller to adjust the amount of toner carried thereon.

Such configurations are advantageous in that toner present on the projections can be removed by the developer regulator and that the amount of toner carried on the development roller can be constant because only toner present inside the recesses can be carried thereon. The amount of toner carried to a development range can be set to a desired amount by designing the recesses to have a desired capacity to contain toner.

Additionally, providing a supply roller at a position facing the development roller is proposed. Toner contained in a toner containing chamber provided inside the development device is supplied by the supply roller to the development roller in a supply nip where the supply roller faces the development roller. As the development roller rotates, toner supplied thereto passes through the development range, returns to the supply nip, and then is collected by the supply roller. The supply roller and the development roller may rotate in an identical direction in the supply nip.

BRIEF SUMMARY OF THE INVENTION

In view of the foregoing, one embodiment of the present invention provides a development device that includes a developer bearer to carry by rotation developer to a development range facing a latent image bearer, and a planar metal developer regulator to adjust an amount of developer carried by the developer bearer to the development range. The developer bearer includes a developer carrying range having surface unevenness. The developer regulator includes a fixed end portion held by a regulator holder and a free end portion to contact a surface of the developer bearer.

Another embodiment provides an image forming apparatus that includes a latent image bearer, a charging member to charge a surface of the latent image bearer uniformly, a latent image forming device to form a latent image on the latent image bearer, and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
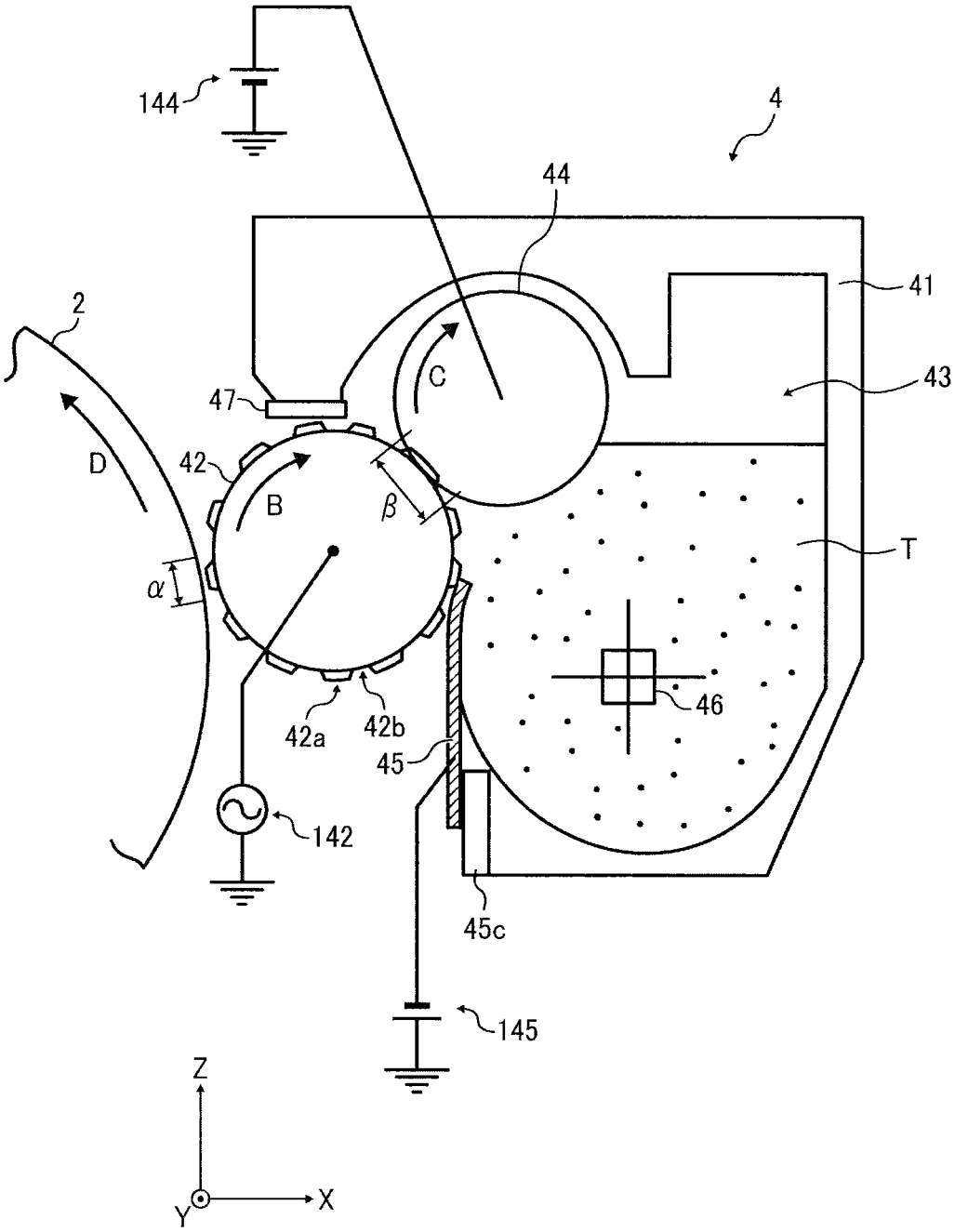
FIG. 1 is a schematic end-on axial view of a development device according to a first embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

(First Embodiment)

Figure 2:
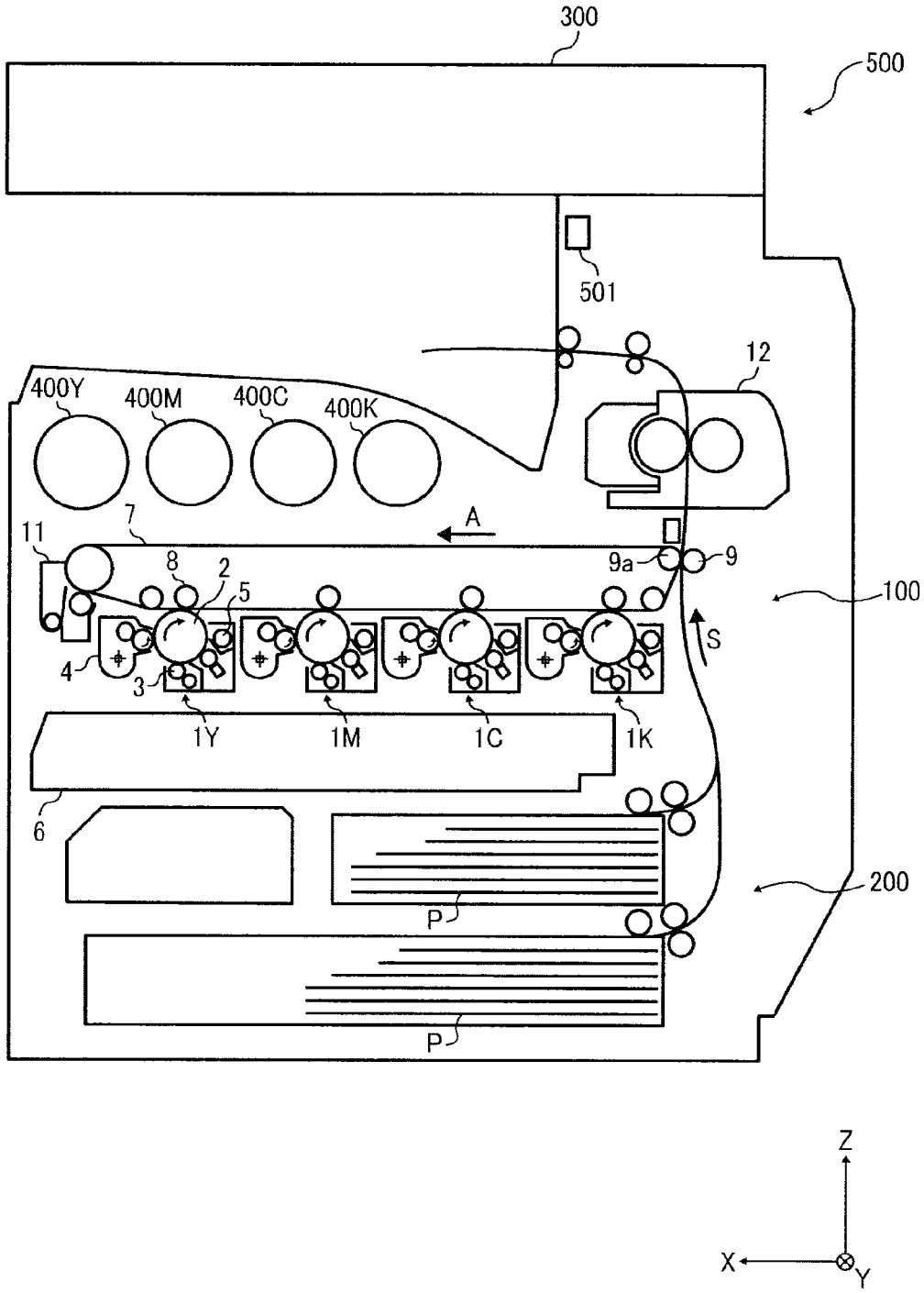
FIG. 2 is a schematic diagram illustrating an image forming apparatus according to an embodiment.

Referring now to the drawings, wherein like reference numerals designate identical or corresponding parts throughout the several views thereof, and particularly to FIGS. 1 and 2, a development device according to a first embodiment of the present invention and a multicolor image forming apparatus incorporating the development device is described.

FIG. 1 is a schematic end-on axial view of a development device according to the present embodiment, as viewed from the back of the paper on which FIG. 2 is drawn. FIG. 2 is a schematic diagram that illustrates a configuration of an image forming apparatus 500 incorporating the development device according to the present embodiment.

The image forming apparatus 500 includes a body or printer unit 100, a sheet-feeding table or sheet feeder 200, and a scanner 300 provided above the printer unit 100.

The printer unit 100 includes four process cartridges 1Y, 1M, 1C, and 1K, an intermediate transfer belt 7 serving as an intermediate transfer member that rotates in the direction indicated by arrow A shown in FIG. 2 (hereinafter "belt travel direction"), an exposure unit 6, and a fixing device 12. The image forming apparatus 500 further includes an alert lamp 501 to alert users malfunction of the apparatus and the like.

It is to be noted that the suffixes Y, M, C, and K attached to each reference numeral indicate only that components indicated thereby are used for forming yellow, magenta, cyan, and black images, respectively. The four process cartridges 1 have a similar configuration except the color of toner used therein, and hereinafter the suffixes Y, M, C, and K may be omitted when color discrimination is not necessary.

Each process cartridge 1 includes a photoreceptor 2, a charging member 3, a development device 4, and a drum cleaning unit 5, and these components are housed in a common unit casing, thus forming a modular unit. The process cartridge 1 can be installed in the body 100 of the image forming apparatus 500 and removed therefrom by releasing a stopper.

The photoreceptor 2 rotates clockwise in the drawing as indicated by arrow shown therein. The charging member 3 can be a charging roller. The charging member 3 is pressed against a surface of the photoreceptor 2 and rotates as the photoreceptor 2 rotates. In image formation, a high-voltage power source applies a predetermined bias voltage to the charging member 3 so that the charging member 3 can electrically charge the surface of the photoreceptor 2 uniformly. Although the process cartridge 1 according to the present embodiment includes the charging member 3 that contacts the surface of the photoreceptor 2, alternatively, contactless charging members such as corona charging members may be used instead.

The exposure unit 6 exposes the surface of the photoreceptor 2 according to image data read by the scanner 300 or acquired by external devices such as computers, thereby forming an electrostatic latent image thereon. Although the exposure unit 6 in the configuration shown in FIG. 2 employs a laser beam scanning method using a laser diode, other configurations such as those using light-emitting diode (LED) arrays may be used.

The drum cleaning unit 5 removes toner remaining on the photoreceptor 2 after the photoreceptor 2 passes by a position facing the intermediate transfer belt 7.

The four process cartridges 1 form yellow, cyan, magenta, and black toner images on the respective photoreceptors 2. The four process cartridges 1 are arranged in parallel to the belt travel direction indicated by arrow A. The toner images formed on the respective photoreceptors 2 are transferred therefrom and superimposed sequentially one on another on the intermediate transfer belt 7 (primary-transfer process). Thus, a multicolor toner image is formed on the intermediate transfer belt 7.

In FIG. 2, primary-transfer rollers 8 serving as primary-transfer members are provided at positions facing the respective photoreceptors 2 via the intermediate transfer belt 7. Receiving a primary-transfer bias from a high-voltage power source, the primary-transfer roller 8 generates a primary-transfer electrical field between the photoreceptor 2 and the primary-transfer roller 8. With the primary-transfer electrical field, the toner images are transferred from the respective photoreceptors 2 onto the intermediate transfer belt 7. As one of multiple tension rollers around which the intermediate transfer belt 7 is looped is rotated by a driving roller, the intermediate transfer belt 7 rotates in the belt travel direction indicated by arrow A shown in FIG. 2. While the toner images are superimposed sequentially on the rotating intermediate transfer belt 7, the multicolor toner image is formed thereon.

Among the multiple tension rollers, a tension roller 9*a* is disposed downstream from the four process cartridges 1 in the belt travel direction indicated by arrow A and presses against a secondary-transfer roller 9 via the intermediate transfer belt 7, thus forming a secondary-transfer nip therebetween. The tension roller 9*a* is also referred to as a secondary-transfer facing roller 9*a*. A predetermined voltage is applied to the secondary-transfer roller 9 or the secondary-transfer facing roller 9*a* to generate a secondary-transfer electrical field therebetween. Sheets P fed by the sheet feeder 200 are transported in the direction indicated by arrow S shown in FIG. 2 (hereinafter "sheet conveyance direction"). When the sheet P passes through the secondary-transfer nip, the multicolor toner image is transferred from the intermediate transfer belt 7 onto the sheet P by the effects of the secondary-transfer electrical field (secondary-transfer process).

The fixing device 12 is disposed downstream from the secondary-transfer nip in the sheet conveyance direction. The fixing device 12 fixes the multicolor toner image with heat and pressure on the sheet P that has passed through the secondary-transfer nip, after which the sheet P is discharged outside the image forming apparatus 500.

Meanwhile, a belt cleaning unit 11 removes toner remaining on the intermediate transfer belt 7 after the secondary-transfer process.

Additionally, toner bottles 400Y, 400M, 400C, and 400K containing respective color toners are provided above the intermediate transfer belt 7. The toner bottles 400 are removably installed in the body 100. Toner is supplied from the toner bottle 400 by a toner supply device to the development device 4 for the corresponding color.

Figure 3:
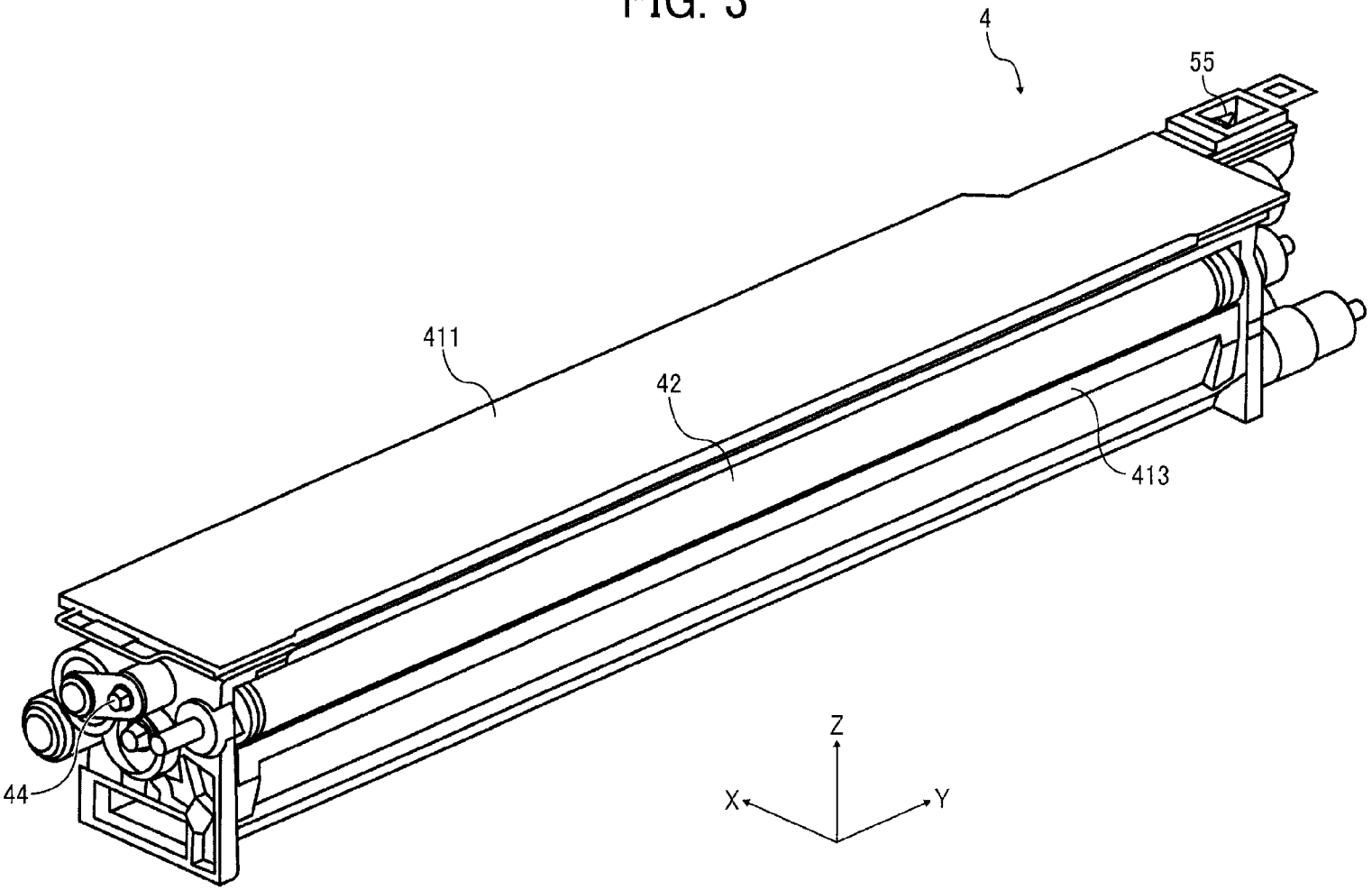
FIG. 3 is a perspective view of the development device according to the first embodiment.
Figure 4:
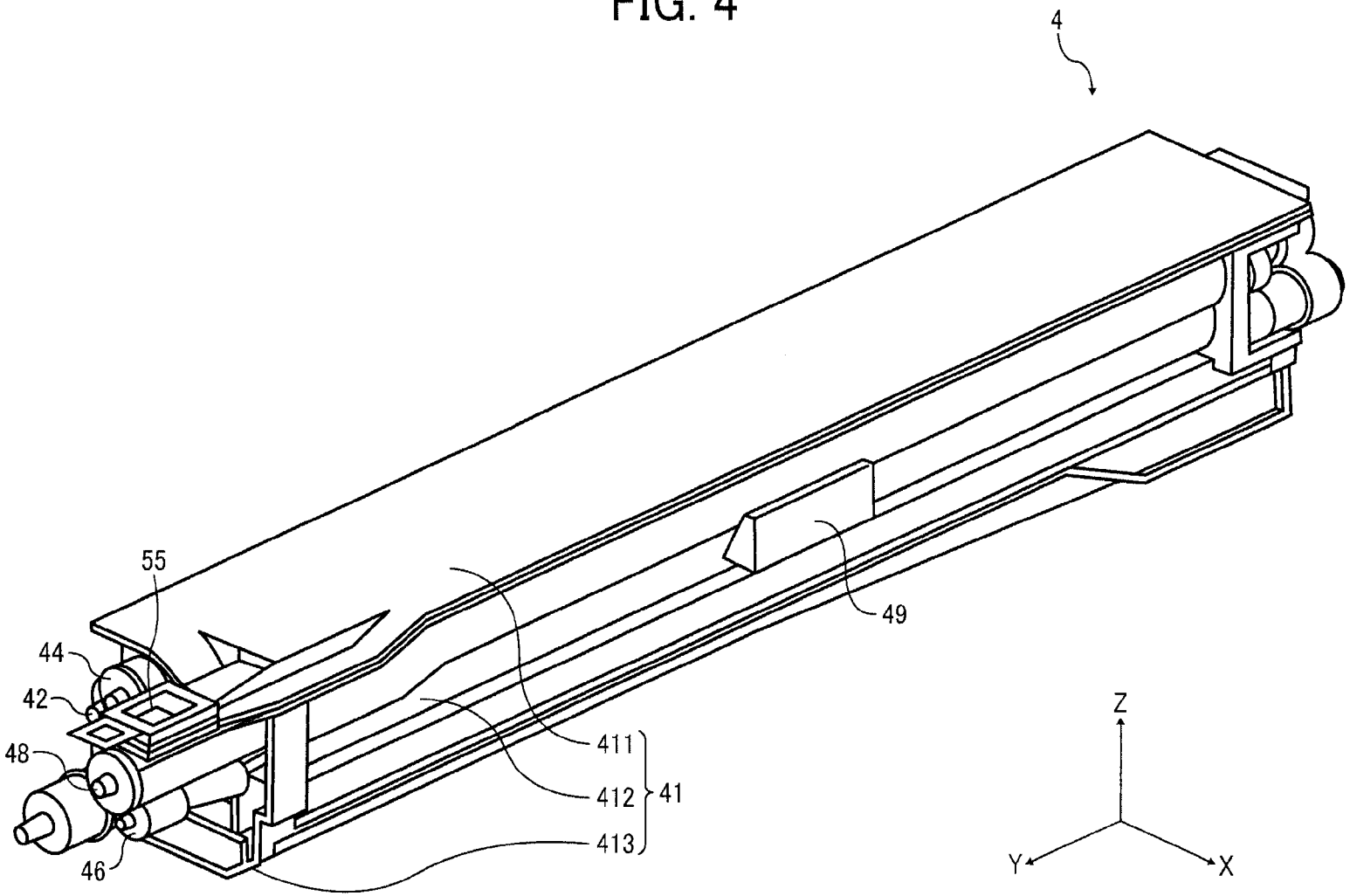
FIG. 4 is another perspective view of the development device according to the first embodiment.

FIGS. 3 and 4 are perspective views of the development device 4 as viewed from above obliquely in different directions.

Referring to FIG. 4, an upper case 411, an intermediate case 412, and a lower case 413 together form a development casing 41 of the development device 4. The intermediate case 412 forms a toner containing chamber 43 (shown in FIG. 1), and a toner supply inlet 55 communicating with the toner containing chamber 43 is formed in the upper case 411. Additionally, as shown in FIG. 1, an entrance seal 47 (shown in FIG. 1) is provided to seal clearance between the upper case 411 and a development roller 42.

Figure 5:
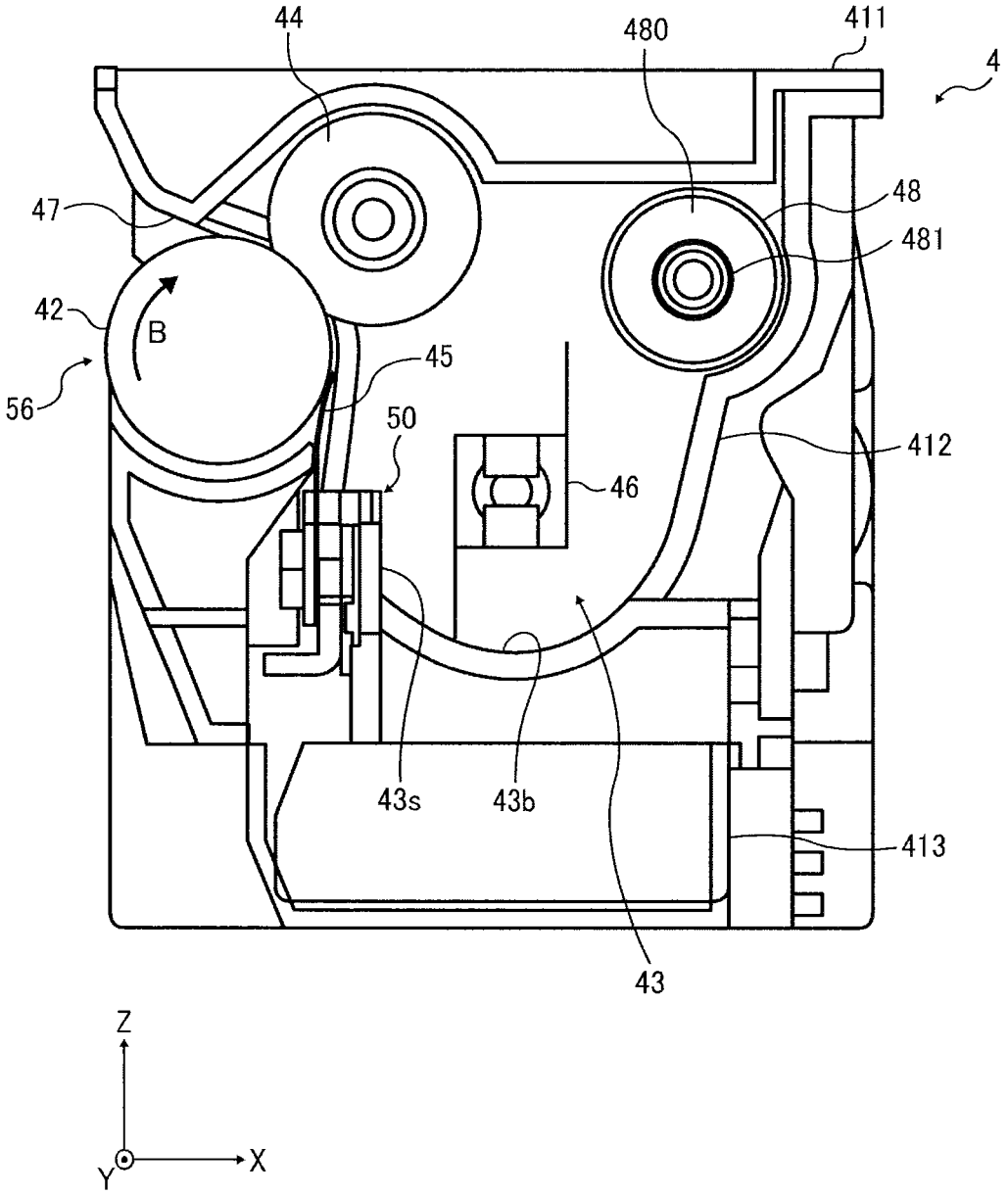
FIG. 5 is a cross-sectional view of the development device according to the first embodiment.
Figure 6:
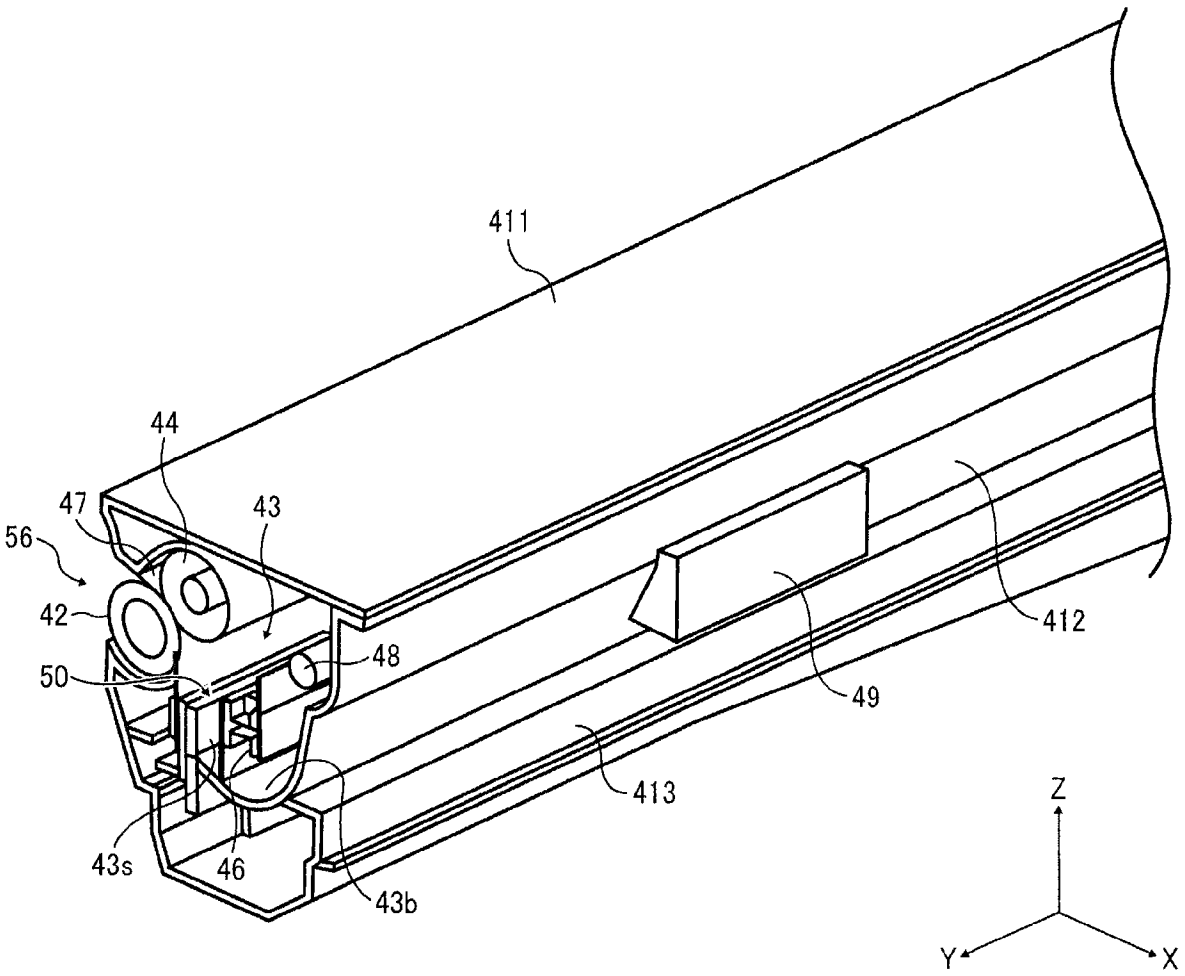
FIG. 6 is a perspective view that partly illustrates the development device according to the first embodiment.

FIG. 5 is a cross-sectional view of the development device 4 as viewed in the direction in which the development device 4 shown in FIG. 1 is viewed. FIG. 6 is an enlarged view of a part of the development device 4 using a Z-X cross-sectional view.

Inside the intermediate case 412, the development roller 42, a supply roller 44, a doctor blade 45, a paddle 46, a supply screw 48, and a toner amount detector 49 (shown in FIG. 4) are provided.

An interior of the development device 4 communicates with the outside through an opening 56 (shown in FIG. 5) extending in the longitudinal direction of the development device 4 (Y-axis direction in the drawings). The development roller 42 is cylindrical and transports toner contained in the development casing 41 through the opening 56 to a development range a facing the photoreceptor 2, outside the development device 4. It is to be noted that the term "cylindrical" used in this specification is not limited to round columns but also includes polygonal prisms.

It is to be noted that, in FIG. 1, reference numerals 142, 144, and 145 represent bias power sources, and reference character 45*c* represents a blade holder. Further, in FIG. 5, reference characters 481 represents a screw shaft 481 of the supply screw 48, 480 represents a spiral blade, 43*s* represents side walls of the toner containing chamber 43, 43*b* represents an inner bottom face 43*b* of the toner containing chamber 43, and 50 represents a step at the side wall 43*s*.

While rotating clockwise in FIG. 1 as indicated by arrow C (hereinafter "direction C in which the supply roller 44 rotates"), the supply roller 44 supplies toner T from the toner containing chamber 43 to a supply nip β, which is a range facing the development roller 42, thereby supplying toner T to the surface of the development roller 42. The development roller 42 carries toner on the surface thereof and rotates clockwise in FIG. 1 as indicated by arrow B. Thus, toner is transported to a toner regulation range facing the doctor blade 45, where the amount of toner on the development roller 42 is adjusted to a predetermined amount.

A tip portion of the doctor blade 45 contacts the surface of the development roller 42 at a position facing the development roller 42 (toner regulation range) in a direction counter to the direction indicated by arrow B (hereinafter "direction B") in which the development roller 42 rotates. That is, the tip portion of the doctor blade 45 is positioned upstream from a base portion thereof in the direction B in which the development roller 42 rotates. After the amount of toner is adjusted by the doctor blade 45, toner reaches the development range α as the development roller 42 rotates.

In the supply nip β, the surface of the supply roller 44 moves upward, whereas the surface of the development roller 42 moves downward. It is to be noted that, in the present embodiment, the supply roller 44 is in contact with the development roller 42 in the supply nip β.

In the development range α, a development field is generated by differences in electrical potential between the latent image formed on the photoreceptor 2 and a development bias applied from the development bias power source 142 to the development roller 42. The development field moves toner carried on the development roller 42 toward the surface of the photoreceptor 2, thus developing the latent image into a toner image. The photoreceptor 2 is contactless with the development roller 42 and rotates in the direction indicated by arrow D shown in FIG. 1. Accordingly, the surface of the development roller 42 and that of the photoreceptor 2 move in an identical direction in the development range α.

The development bias power source 142 applies alternating voltage to the development roller 42. The alternating voltage includes a first voltage to direct toner from the development roller 42 to the photoreceptor 2 and a second voltage to direct toner from the photoreceptor 2 to the development roller 42 for developing the latent image with toner transported to the development range α.

Referring to FIG. 1, the outer circumferential surface of the development roller 42 has surface unevenness over the entire circumference. More specifically, multiple projections 42*a* having a substantially identical height and multiple recesses 42*b* having a substantially identical depth are formed regularly in the circumferential surface of the development roller 42, which is described in further detail later.

Toner T that is not used in image development but has passed through the development range α is collected from the surface of the development roller 42 by the supply roller 44 on an upstream side of the supply nip β in the direction B (shown in FIG. 1) in which the development roller 42 rotates, thus initialize the surface of the development roller 42. In other words, the supply roller 44 can also serve as a collecting roller.

Generally, toner T held in the recesses 42*b* formed regularly in the surface of the development roller 42 is not easily removed therefrom. If toner T that has passed through the development range a remains on the development roller 42 and passes through the supply nip β, it is possible that the toner T firmly adheres to the development roller 42, forming a film covering the surface of the development roller 42, which is a phenomenon called "toner filming". Toner filming can cause fluctuations in the charge amount of toner carried on the development roller 42 per unit amount, the amount of toner carried on the development roller 42 per unit area, or both, making image density uneven.

In view of the foregoing, in the development device 4 according to the first embodiment, the development roller 42 and the supply roller 44 rotate in the opposite directions in the supply nip β. This configuration can increase the difference in linear velocity between the surface of the development roller 42 and that of the supply roller 44 in the supply nip β, and accordingly collection of toner by the supply roller 44 in the supply nip β can be facilitated. Since toner can be prevented from being carried over on the development roller 42, adhesion of toner to the development roller 42 can be inhibited. Consequently, density unevenness in image development resulting from toner adhesion can be reduced.

Additionally, in this regard, it is preferable that the linear velocity of the development roller 42 is higher. For example, in the first embodiment, the ratio of linear velocity of the development roller 42 to that of the supply roller 44 can be 1:0.85, but the linear velocity ratio is not limited thereto.

Additionally, in the configuration shown in FIG. 1, the supply roller 44 is disposed above the toner containing chamber 43 or in an upper portion of the toner containing chamber 43 such that the supply roller 44 is positioned, at least partly, above the level (surface) of toner T inside the toner containing chamber 43 when the paddle 46 is motionless. Further, an area downstream from the supply nip β in the direction C in which the supply roller 44 rotates is positioned above the level of toner T. In particular, in a comparative configuration in which the area downstream from the supply nip β is filled with toner, it is possible that the toner blocks incoming toner, thus inhibiting collection of toner from the development roller 42 in the supply nip β. By contrast, in the first embodiment, since the area downstream from the supply nip β in the direction C is positioned above the level of toner T as shown in FIG. 4, toner is not present in that area, and collection of toner from the development roller 42 in the supply nip β is not hindered. Thus, collection of toner and initialization of the development roller 42 can be performed efficiently.

Figure 7:
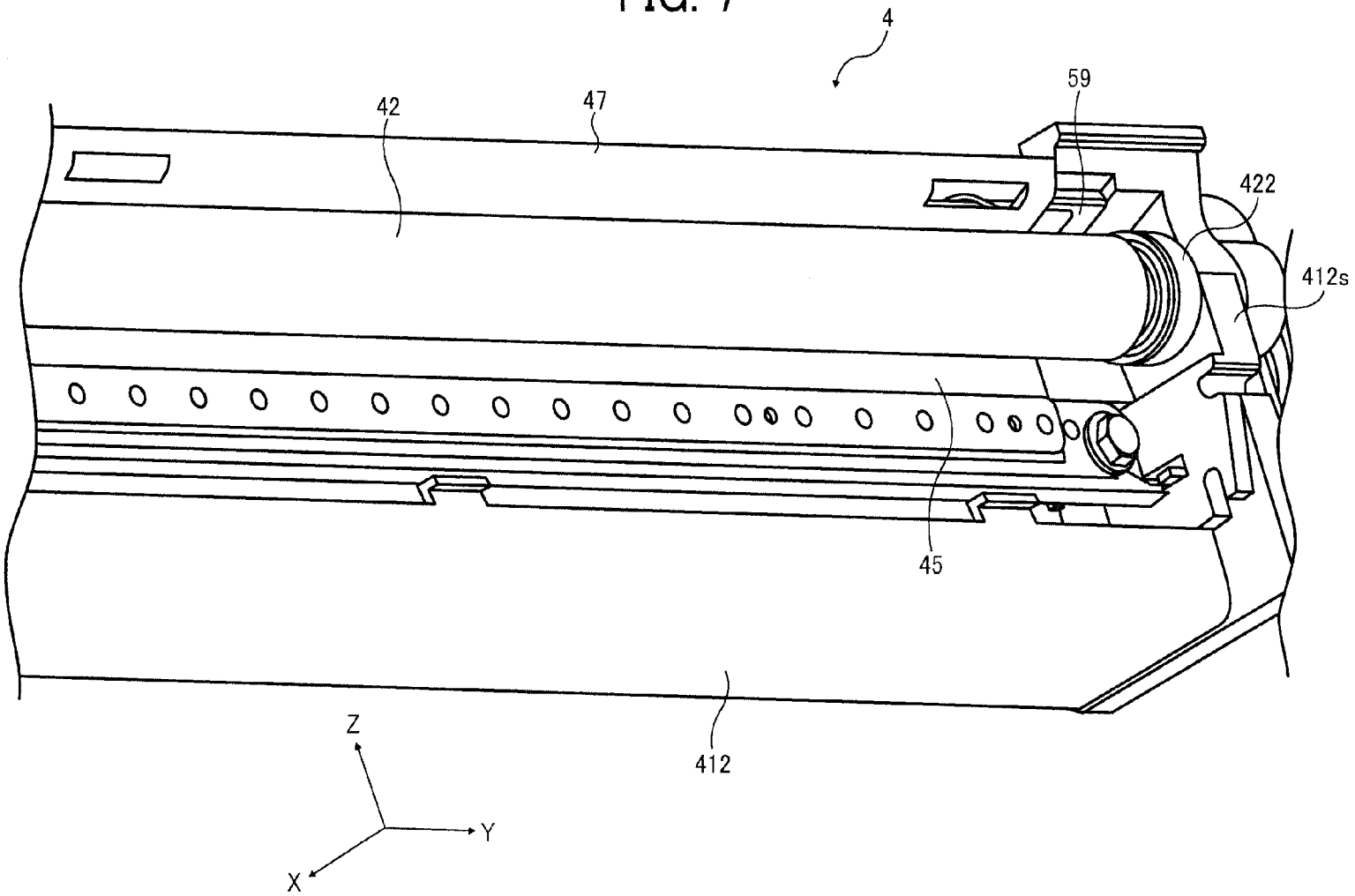
FIG. 7 is an enlarged perspective view illustrating an axial end portion of the development device, in which a lower case is omitted.
Figure 8:
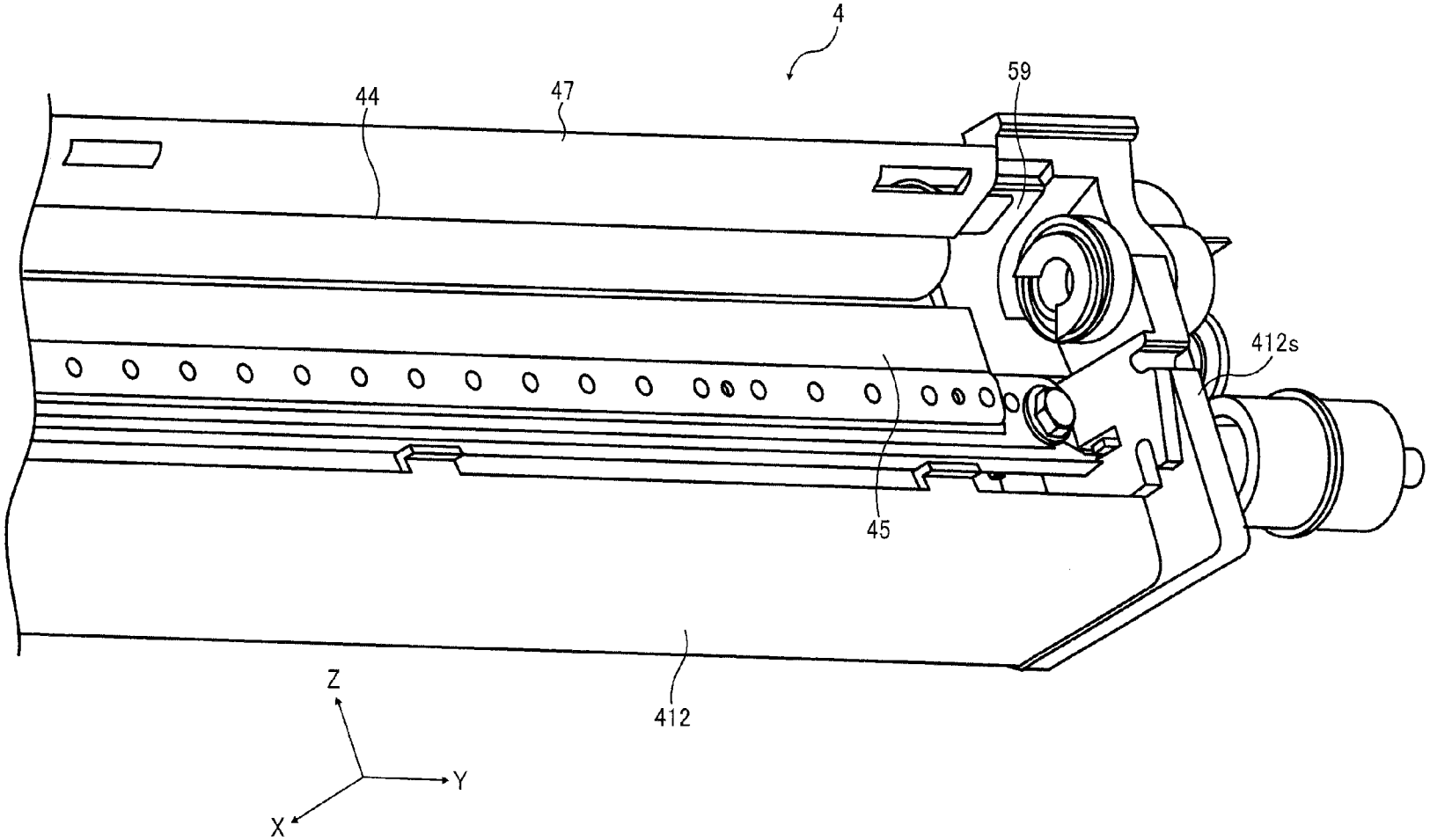
FIG. 8 is an enlarged perspective view illustrating a state in which the development roller is removed from the development device shown in FIG. 7.

FIG. 7 is an enlarged perspective view illustrating an axial end portion of the development device 4 (on the back side of the paper on which FIG. 2 is drawn), from which the lower case 413 is removed. FIG. 8 is an enlarged perspective view illustrating the development device 4, from which the development roller 42 and the lower case 413 are removed. It is to be noted that reference numeral 422 shown in FIG. 7 represent a pair of spacers provided to axial end portions of the development roller 42, and reference character 412*s* represents side walls of the intermediate case 412.

Figure 9:
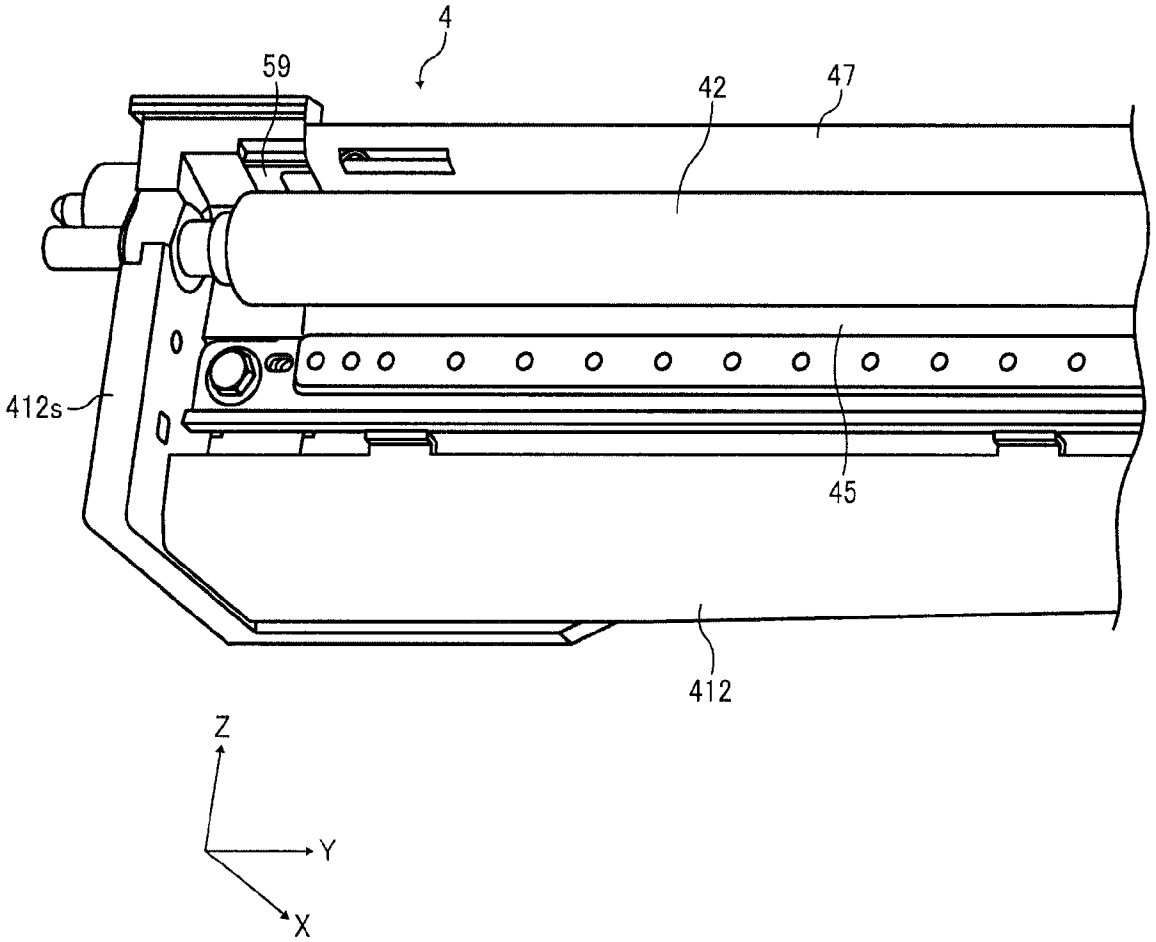
FIG. 9 is an enlarged perspective view illustrating another axial end portion of the development device, in which the lower case is omitted.
Figure 10:
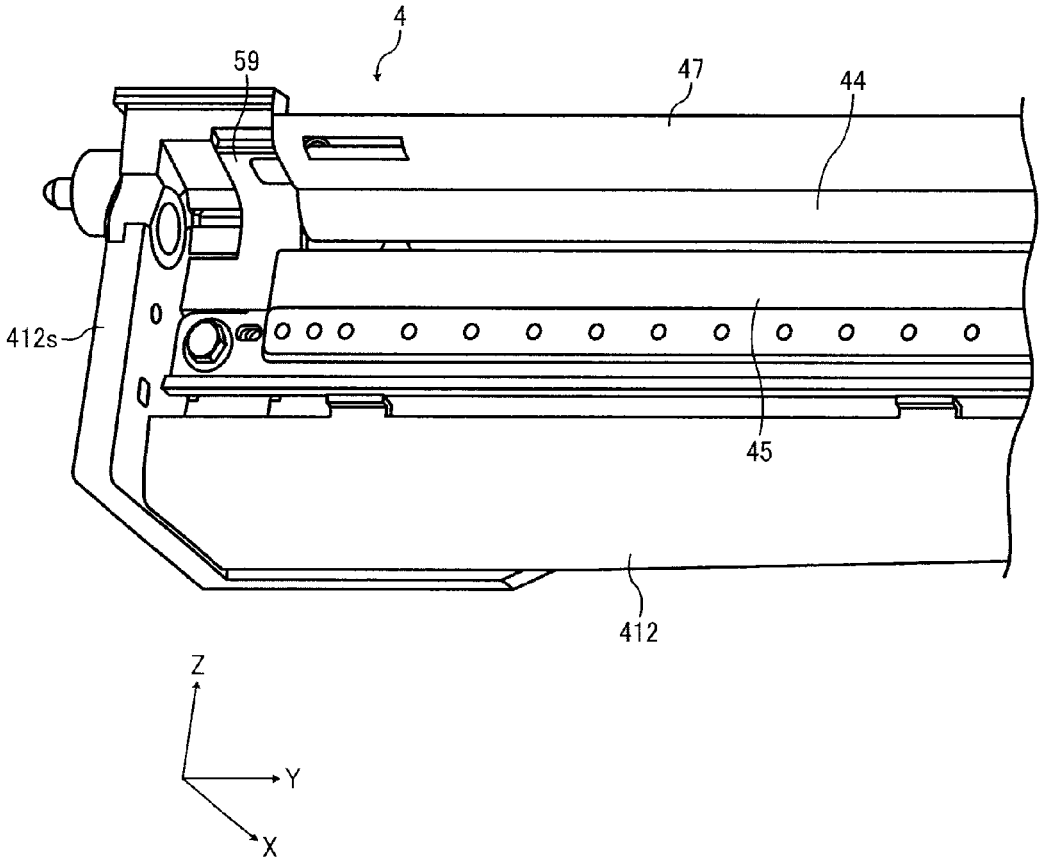
FIG. 10 is an enlarged perspective view illustrating a state in which the development roller is removed from the development device shown in FIG. 9.

FIG. 9 is an enlarged perspective view illustrating the other axial end portion of the development device 4 (on the front side of the paper on which FIG. 2 is drawn), from which the lower case 413 is removed. FIG. 10 is an enlarged perspective view illustrating the development device 4, from which the development roller 42 and the lower case 413 are removed.

The entrance seal 47 extending in the longitudinal direction is bonded to the rim of the upper case 411 forming the opening 56. The entrance seal 47 can be a sheet member formed of Mylar or the like. The entrance seal 47 is substantially rectangular. An end on its shorter side is bonded to the rim of the upper case 411, and other end is free. The free end of the entrance seal 47 projects inwardly in the development device 4 and is disposed to contact the development roller 42. An upstream side of the entrance seal 47 in the direction B in which the development roller 42 rotates is bonded to the upper case 411 with a downstream side left free such that a planar portion of the entrance seal 47 can contact the development roller 42. Additionally, an inner face (lower face) of the upper case 411 is curved in conformity to the shape of the supply roller 44, and a clearance of about 1.0 mm is provided between the curved inner face of the upper case 411 and the supply roller 44.

As shown in FIGS. 7 through 10, lateral end seals 59 are bonded to portions of the intermediate case 412 at longitudinal end portions of the opening 56. The lateral end seals 59 are positioned inside the spacers 422 provided to the axial end portions of the development roller 42. The lateral end seals 59 are disposed to overlap with the axial end portions of the doctor blade 45 that contacts the development roller 42 in the axial direction. The lateral end seals 59 are designed to prevent leakage of toner at the longitudinal ends of the opening 56 formed in the development casing 41.

The mount of toner remaining inside the toner containing chamber 43 can be detected using the toner amount detector 49 provided to the intermediate case 412.

Next, the development roller 42 is described in further detail below.

Figure 11:
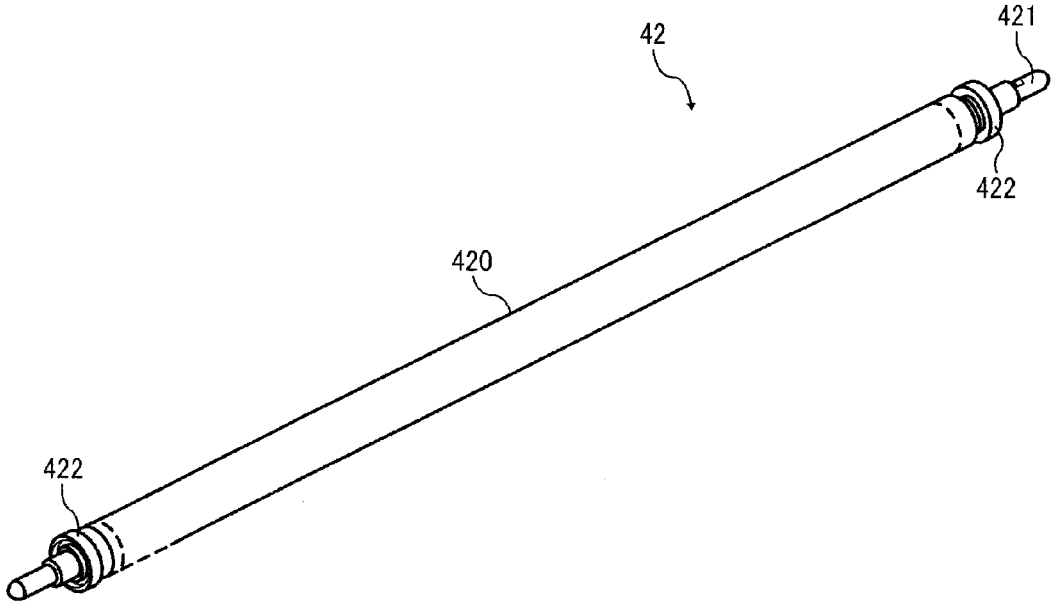
FIG. 11 is a perspective view of a development roller.
Figure 12:
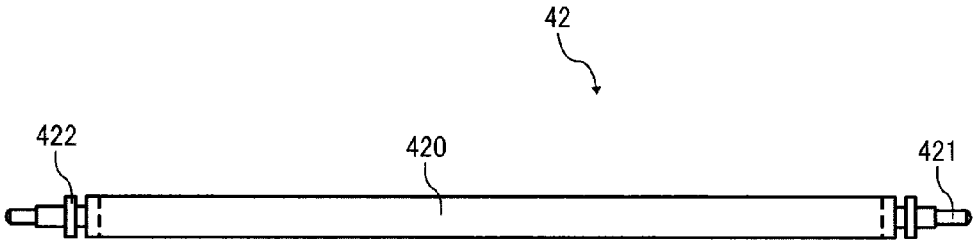
FIG. 12 is a side view of the development roller shown in FIG. 11.

FIG. 11 is a perspective view of the development roller 42, and FIG. 12 is a side view of the development roller 42.

The development roller 42 includes a roller shaft 421, a development sleeve 420, and the pair of spacers 420 provided to both axial end portions of the roller shaft 421. The spacers 422 are positioned outside the development sleeve 420 in the axial direction of the development roller 42.

The development roller 42 is rotatable upon the roller shaft 421 and is disposed with the axial direction thereof parallel to the longitudinal direction of the development device 4 or Y-axis in the drawings. Both axial end portions of the roller shaft 421 are rotatably supported by the side walls 412*s* (shown in FIG. 10) of the intermediate case 412. The circumferential surface of the development roller 42 is partly exposed through the opening 56, and the development roller 42 rotates in the direction indicated by arrow B shown in FIG. 1 so that the exposed surface of the development roller 42 moves and transports toner upward.

Additionally, the spacers 422 provided to either axial end portion contact the surface of the photoreceptor 2, and the distance between the surface of the development sleeve 420 and the surface of the photoreceptor 2 (i.e., development gap) in the development range α can be kept constant.

Figure 13:
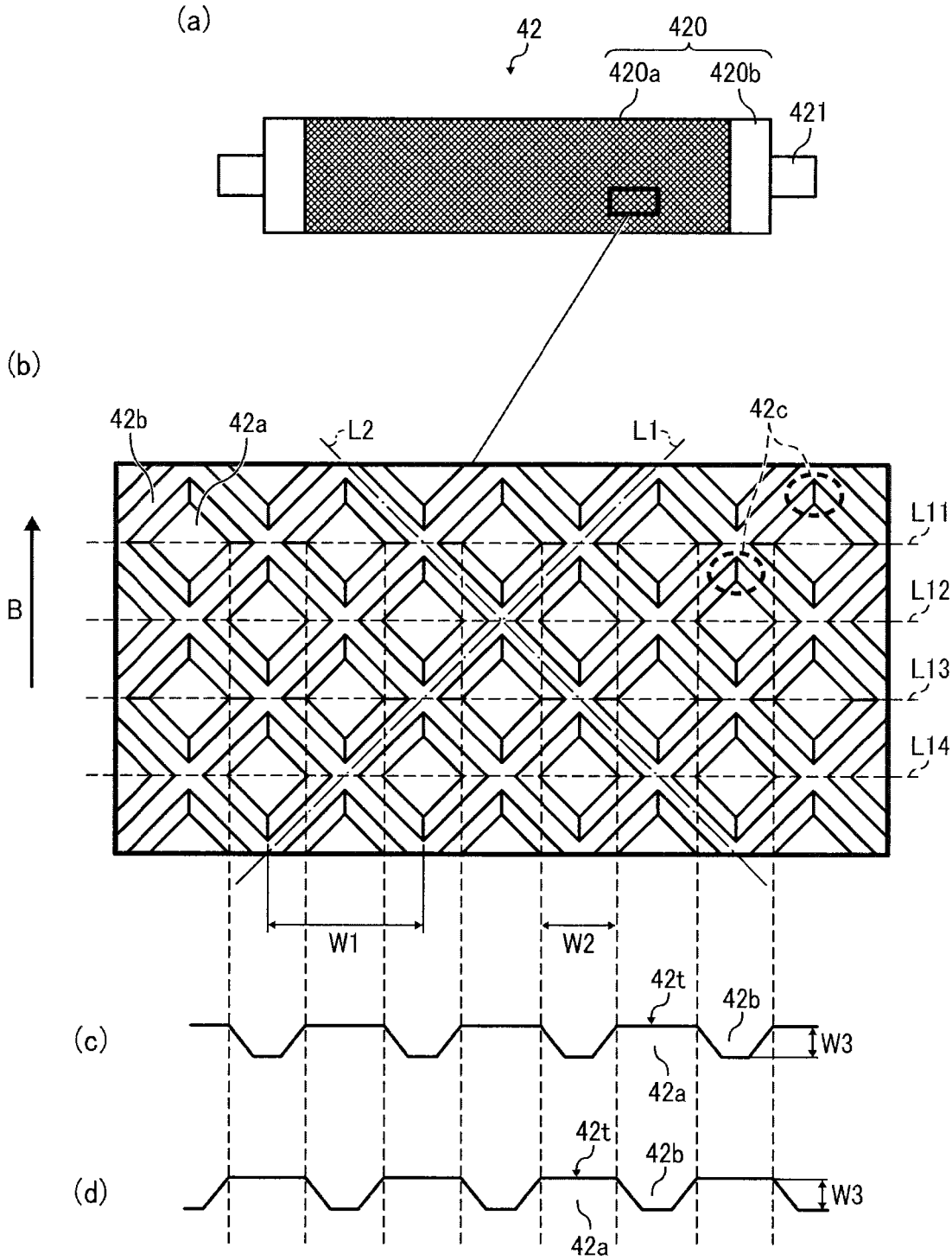
FIG. 13 illustrates a surface configuration of the development roller.

FIG. 13 illustrates a surface configuration of the development roller 42. In FIG. 13, (a) schematically illustrates the development roller 42 entirely, and (b) is an enlarged view of an area enclosed with a rectangle in (a). Further, (c) and (d) illustrate cross sections of a surface layer 42*f* (shown in FIG. 31) along line L11 or L13 and a cross section along line L12 or L14 in (b).

The development roller 42 (development sleeve 420) includes a base 42*g* (shown in FIG. 31) and the surface layer 42*f* formed on the outer circumferential surface of the base 42*g*. The base 42*g* can be a metal sleeve constructed of aluminum alloy such as 5056 or 6063 (HS standard); or iron alloy such as Carbon Steel Tubes for Machine Structural Purposes (STKM, JIS standard), for example. The base 42*g* that is a metal sleeve is processed to have surface unevenness, and the surface is plated with nickel, thereby forming the surface layer 42*f* for preventing corrosion of the development roller 42 (development sleeve 420) and facilitating toner charging.

As shown in (a) of FIG. 13, the development sleeve 420 includes two types of ranges different in surface structure, namely, a grooved range 420*a* having surface unevenness and smooth surface ranges 420*b* (non-groove range) without surface unevenness. The smooth surface ranges 420*b* are positioned outside the grooved range 420*a* in the axial direction.

The grooved area 420*a* is a portion including an axial center of the development roller 42, and the surface thereof is processed to have irregularities to carry toner thereon properly. Thus, the grooved area 420*a* can serve as a developer carrying range. In the first embodiment, surface unevenness can be formed through rolling, and the projections 42*a* are enclosed by first and second spiral grooves L1 and L2 winding in different directions. While the spiral grooves L1 and L2 winding in different directions are formed in the surface of the development roller 42, cancellate surface unevenness, shaped like a mesh, are formed therein. Any known rolling method can be used. Each of the first and second spiral grooves L1 and L2 are oblique to the axial direction of the development roller 42 at a predetermined angle.

It is to be noted that, although both the first and second spiral grooves L1 and L2 are at 45° to the axial direction in the configuration shown in FIG. 13, the angle is not limited thereto, and the first and second spiral grooves L1 and L2 may be different in inclination and cyclic width (pitch).

With the first and second spiral grooves L1 and L2 that are inclined in the respective directions and formed periodically at predetermined cyclic widths, the projections 42*a* are formed at pitch width W1 in the axial direction. A top face 42*t* of the projection 42*a* has a length W2 in the axial direction (hereinafter also "axial length W2") that is equal to or greater than the half of the pitch width W1 in the present embodiment.

In the development roller 42 in the first embodiment, for example, the pitch width W1 of the projections 42*a* in the axial direction can be 80 μm, and the axial length W2 of the top face 42*t* of the projection 42*a* is 40 μm. A depth W3, which is a height of the top face 42*t* from the recess 42*b*, can be 10 μm. The size of the pitch width W1, the axial length W2, and the depth W3 are not limited to the above-described values.

It is preferred that the surface layer 42*f* of the development roller 42 be constructed of a material capable of causing normal charging of toner. Even if low-charge toner particles are present due to filming, low-charge toner particles can be pushed out by jumping toner T and charged at positions free of filming among the projections 42*a* and the recesses 42*b*. Thus, the amount of low-charge toner particles can be reduced, and image density can become constant. In the first embodiment, with nickel-plating, the surface layer 42*f* of the development roller 42 is capable of charging toner normally.

Additionally, the surface layer 42*f* of the development roller 42 is preferably constructed of a material harder than doctor blade 45 (or blade member 450). With this configuration, the projections 42*a* of the development roller 42 are not easily abraded by the doctor blade 45, and a capacity (volume) of the recess 42*b* enclosed by the projections 42*a* and the doctor blade 45 does not change easily. Thus, an amount of toner (hereinafter "toner amount M") carried on a unit area (hereinafter "roller unit area A") of the development roller 42 (M/A) can be stable.

Additionally, it is preferable that the height of the projection 42*a* be greater than the weight average particle size of toner T used. With this configuration, since toner T of average particle size can be contained inside the recess 42*b*, selection of particle size can be inhibited. Accordingly, the toner amount M on the roller unit area A (M/A) can be stable over time. It is to be noted that reference character 42*c* shown in FIG. 13 represents a downstream portion of the projection 42*a* in the direction B.

Next, the supply roller 44 is described in further detail below.

Figure 14:
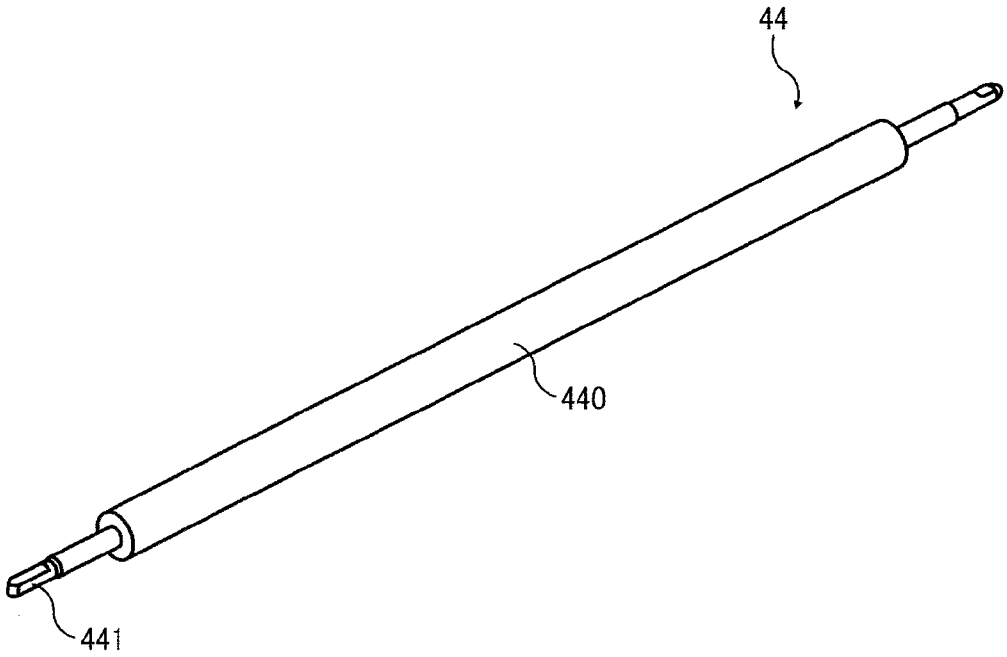
FIG. 14 is a perspective view of a supply roller.
Figure 15:
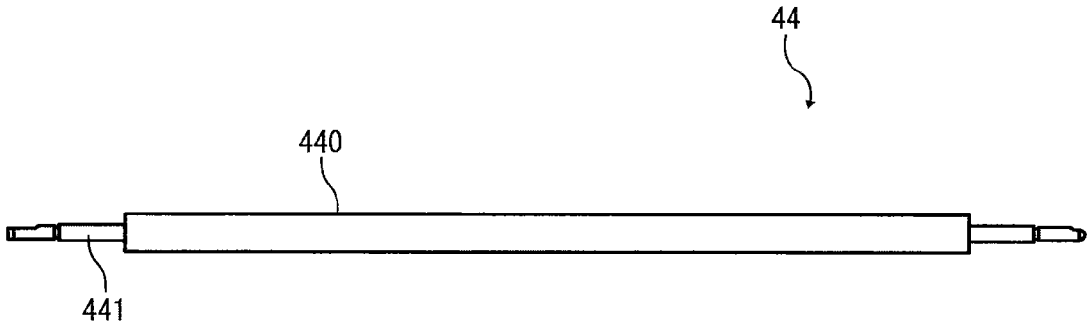
FIG. 15 is a side view of the supply roller.

FIG. 14 is a perspective view of the supply roller 44, and FIG. 15 is a side view of the supply roller 44. The supply roller 44 is cylindrical and positioned above the toner containing chamber 43 inside the development device 4 and on a side of the development roller 42 in FIG. 1 or 5. Referring to FIGS. 14 and 15, the supply roller 44 includes a roller shaft 441 and a supply sleeve 440 constructed of a cylindrical foam member winding around the roller shaft 441.

The supply roller 44 can rotate about the roller shaft 441 that is rotatably supported by the side walls 412*s* of the intermediate case 412. The supply roller 44 is disposed such that a part of the outer circumferential surface of the supply sleeve 440 contacts the outer circumferential surface of the development sleeve 420 of the development roller 42, thus forming the supply nip β. As shown in FIGS. 1 and 5, the roller shaft 441 of the supply roller 44 is positioned above the roller shaft 421 of the development roller 42.

Further, in the supply nip β, the supply roller 44 rotates in the direction opposite the direction in which the surface of the development roller 42 moves as described above. In the configuration shown in FIG. 1, the supply nip β is positioned above the position where the doctor blade 45 contacts the development roller 42.

The supply sleeve 440 of the supply roller 44 is constructed of a foamed material, and a number of minute pores are diffused in a surface layer (sponge surface layer) thereof that contacts the development roller 42. The sponge surface layer of the supply roller 44 can make it ease for the supply roller 44 to reach the bottom of the recess 42*b*, thus facilitating resetting toner on the development roller 42.

Additionally, the amount by which the supply roller 44 extends into the range of the development roller 42, which can be expressed as the radius of the development roller 42 plus the radius of the supply roller 44 minus the distance between the axes of the development roller 42 and the supply roller 44, is greater than the height of the projections 42*a* of the development roller 42. With this configuration, toner in the recesses 42*b* can be reset properly. It is to be noted that the above-described amount should not be too large because toner may be pushed in the recesses 42*b* and agglomerate or coagulate if the above-described amount is extremely large relative to the height of the projections 42*a*.

In the present embodiment, a foamed material having an electrical resistance within a range from about $10^3\Omega$ to about $10^{14}\Omega$ can be used for the supply sleeve 440 of the supply roller 44.

The bias power source 144 applies a supply bias to the supply roller 44, and the supply roller 44 promotes effects of pushing preliminarily charged toner against the development roller 42 in the supply nip β. The supply roller 44 supplies toner carried thereon to the surface of the development roller 42 while rotating clockwise in FIGS. 1 and 5.

Although alternating voltage is applied to the development roller 42, the bias voltage applied from the bias power source 144 to the supply roller 44 is a direct current (DC) voltage in the polarity opposite the polarity of normal charge of toner. In the first embodiment, toner is charged to have negative (minus) polarity, and the supply bias is a DC voltage in positive (plus) polarity. Thus, the voltage applied to not the development roller 42 but the supply roller 44 has the polarity (positive polarity) opposite the polarity of normal charge of toner. With this configuration, an electrical field in the direction for attracting toner T toward the supply roller 44 can be formed in the supply nip β, thus facilitating resetting of toner on the development roller 42. It is to be noted that, depending on the specification of the development device 4, the bias power source 144, which requires a separate DC power source, may be omitted, thereby reducing the cost.

Next, the doctor blade 45 is described below.

Figure 16:
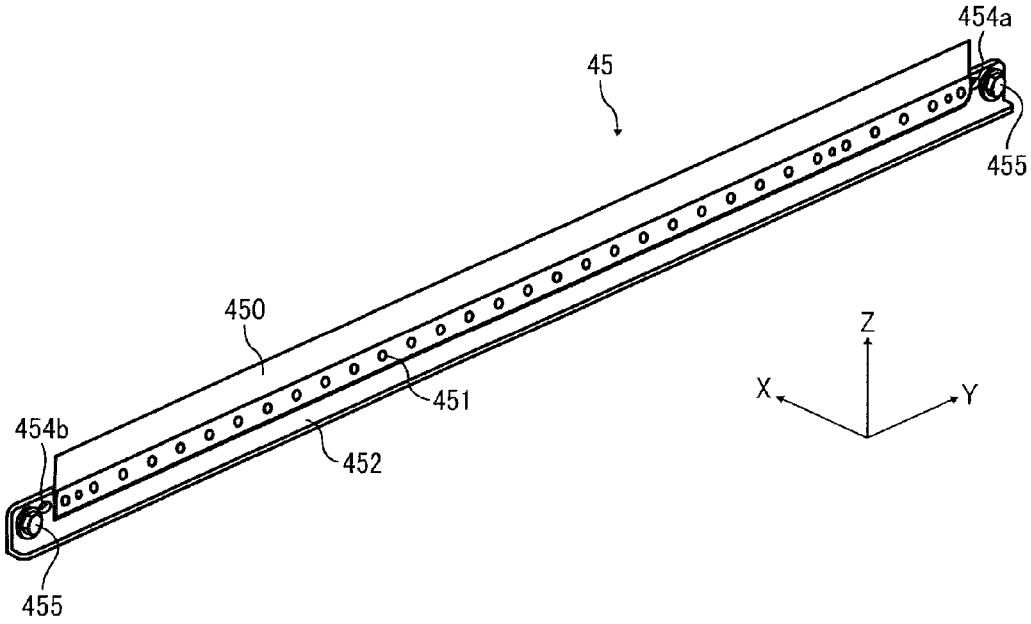
FIG. 16 is a perspective view of a doctor blade.
Figure 17:
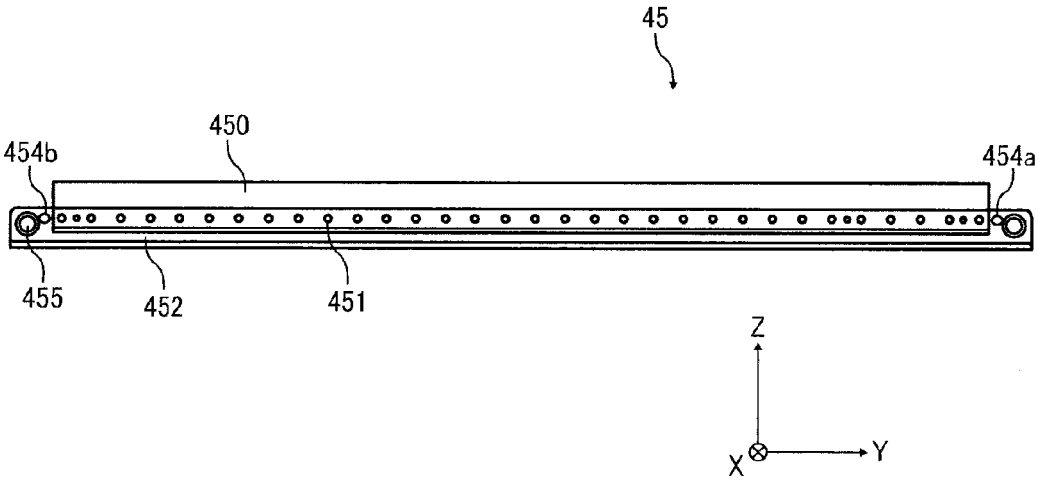
FIG. 17 is a side view of the doctor blade shown in FIG. 16.

FIG. 16 is a perspective view of the doctor blade 45, and FIG. 17 is a side view of the doctor blade 45.

As shown in FIGS. 5 through 10, the doctor blade 45 is provided to the intermediate case 412 positioned beneath the development roller 42 and inside the lower case 413. The doctor blade 45 includes a blade 450 and a metal pedestal 452. The blade 450 can be a thin planar metal member serving as a developer regulating member, and an end (base end) portion of the blade 450 is fixed to the pedestal 452. The other end portion (distal end portion) of the blade 450 contacts the development roller 42. The contact between the blade 450 and the development roller 42 can be either "end contact or edge contact" meaning that an edge portion or corner portion of the blade 450 contacts the development roller 42, or "planar contact" meaning that a part of the face of the blade 450 at a position between the edge portion and the base end contacts the development roller 42. The end contact is advantageous in that the blade 450 can scrape toner off the top face 42*t* of the projections 42*a*, and that only toner contained in the recesses 42*b* can be transported to the development range α. Thus, the amount of toner conveyed to the development range α can be kept constant.

The blade 450 can be fixed to the pedestal 452 using multiple rivets 451. The pedestal 452 is constructed of a metal member thicker than the blade 450 and can serve as a base plate to fix the blade 450 to a body (a side face of the intermediate case 412) of the development device 4. A main positioning pin holes 454*a* that is substantially circular and a sub-positioning pin hole 454*b* shaped into an oval (hereinafter also collectively "pin holes 454") are formed in longitudinal end portions of the pedestal 452. A long diameter of the sub-positioning pin hole 454*b* is oriented to the main positioning pin hole 454*a*. With a pin inserted into the main positioning pin hole 454*a*, the position of the pedestal 452 relative to the body of the development device 4 is determined, and the pedestal 452 can be supported with the sub-positioning pin hole 454*b*. When the pedestal 452 to which the blade 450 is fixed is fixed to the body of the development device 4 with a screw 455, the blade 450 can be fixed to the development device 4.

For example, the blade 450 can be a metal leaf spring constructed of SUS304CSP or SUS301CSP (JIS standard); or phosphor bronze. The distal end (free end) of the blade 450 can be in contact with the surface of the development roller 42 with a pressure of about 10 N/m to 100 N/m, forming a regulation nip. While adjusting the amount of toner passing through the regulation nip, the blade 450 applies electrical charge to toner through triboelectric charging. To promote triboelectric charging, a bias may be applied to the blade 450 from the bias power source 145 shown in FIG. 1.

Additionally, it is preferred that the blade 450 of the doctor blade 45 be electroconductive. When the blade 450 is electroconductive, charge amount of toner T having a greater charge amount Q per unit volume M (Q/M) can be reduced, and the charge amount Q of toner T per unit volume M can become uniform. Accordingly, toner T can be prevented from firmly sticking to the development roller 42.

The bias power source 145 can be configured to apply to the blade 450 a DC voltage within a range of the alternating voltage applied to the development roller 42 ±200 V so that the voltage value can be adjusted in accordance with usage conditions. This configuration can reduce fluctuations in the toner amount M carried on the roller unit area A.

Figure 18:
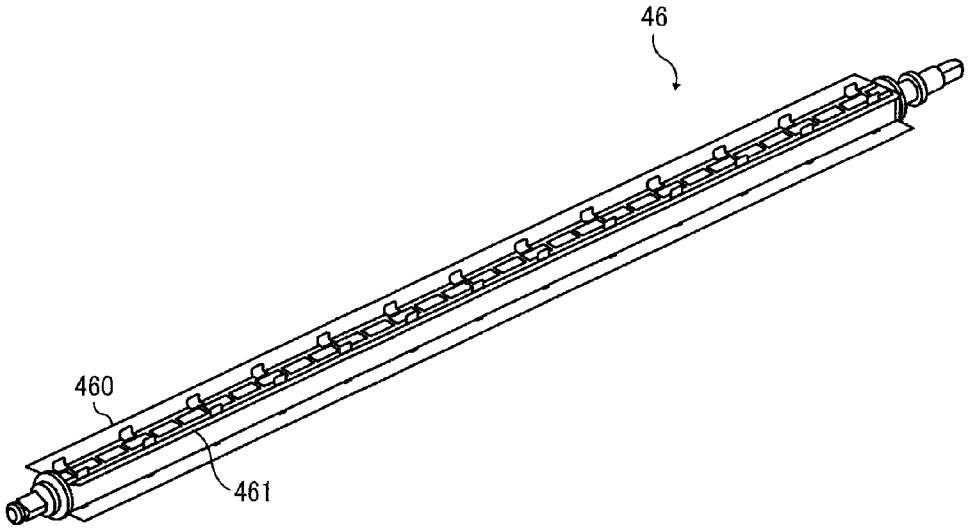
FIG. 18 is a perspective view of a paddle.
Figure 19:
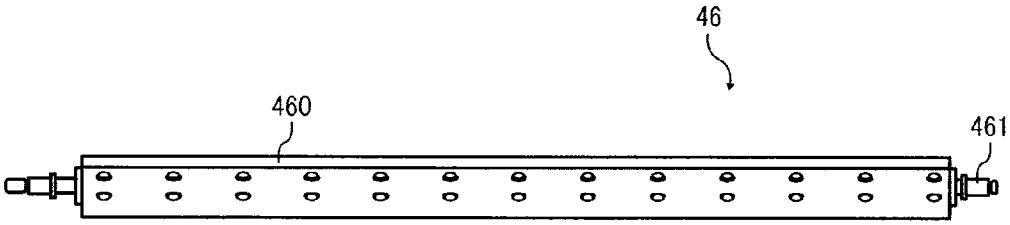
FIG. 19 is a side view of the paddle shown in FIG. 18.

The paddle 46 is described below with reference to FIGS. 18 and 19, which are a perspective view and a side view of the paddle 46, respectively.

The paddle 46 is provided in the toner containing chamber 43 for containing toner and is rotatable relative to the development casing 41. The paddle 46 includes a paddle shaft 461 and thin paddle blades 460 constructed of elastic sheet members such as plastic sheet, Mylar (registered trademark of DuPont). The paddle shaft 461 includes two planar portions facing each other. The two paddle blades 460 are attached to the two planar portions, respectively, to project in the opposite directions beyond the paddle shaft 461.

Multiple holes, arranged in parallel to the paddle shaft 461, are formed in a base portion of the paddle blade 460, and multiple projections, arranged in parallel to the paddle shaft 461, are formed on the paddle shaft 461. The projections of the paddle shaft 461 are inserted into the holes formed in the paddle blade 460 and fixed thereto in thermal caulking. Thus, the paddle blades 460 are fixed to the paddle shaft 461.

The paddle 46 is disposed with the paddle shaft 461 parallel to the longitudinal direction of the development device 4 (Y-axis direction in the drawings). Both axial ends of the paddle shaft 461 are rotatably supported by the side walls 412*s* of the intermediate case 412. A distal end of the paddle blade 460 extending from the paddle shaft 461 projects a length suitable for the distal end to contact an inner wall of the toner containing chamber 43. As shown in FIG. 5, the inner bottom face 43*b* of the toner containing chamber 43 is shaped into an arc confirming to the direction of rotation of the paddle 46 to prevent the paddle blades 460 from being caught on the inner bottom face 43*b* of the toner containing chamber 43 while the paddle 46 rotates.

The inner bottom face 43*b* is continuous with the side wall 43*s* standing vertically on the side of the development roller 42. A top face of the side wall 43*s* parallels X-axis and is horizontal toward the development roller 42. A height of the top face of the side wall 43*s* is similar to or slightly lower than a center of the paddle shaft 461, thus forming the step 50.

A distance between the side wall 43*s* and the paddle shaft 461 is shorter than a distance between the inner bottom face 43*b* and the paddle shaft 461. Therefore, the paddle blades 460, which slidingly contact the inner bottom face 43*b*, can deform more when the paddle blades 460 contact the side wall 43*s*. Then, the paddle blade 460 is released and flipped up when the distal end of the paddle blade 460 reaches the step 50. As the paddle blades 460 thus move, toner can be flipped up, agitated, and transported.

The step 50 has a horizontal face parallel to X-Y plane and extends in the longitudinal direction of the development device 4 (Y-axis direction in the drawings). It is to be noted that, although the step 50 is present over the entire width in the first embodiment, the step 50 may extend partly inside the development device 4 as long as the paddle blades 460 can be flipped up.

The supply screw 48 includes the screw shaft 481 and the spiral blade 480 provided to the screw shaft 48. The supply screw 48 is rotatable upon the screw shaft 481, and screw shaft 481 parallels the longitudinal direction of the development device 4 (Y-axis direction in the drawings). Both axial ends of the screw shaft 481 are rotatably supported by the side walls 412*s* of the intermediate case 412.

An axial end portion of the supply screw 48 is positioned beneath the toner supply inlet 55 (shown in FIGS. 3 and 4) formed in an longitudinal end portion of the development device 4. As the supply screw 48 rotates, the spiral blade 480 transports toner supplied through the toner supply inlet 55 to a longitudinal center portion of the development device 4.

Next, movement of toner inside the development device 4 is described below.

Toner supplied to the development device 4 from the toner supply inlet 55 is transported by the supply screw 48 to the toner containing chamber 43 and agitated by the paddle 46. As the paddle 46 rotates, toner is flipped up toward the development roller 42 and the supply roller 44. The toner supplied to the supply roller 44 is forwarded to the development roller 42 in the supply nip β where the supply roller 44 contacts the development roller 42. Then, the doctor blade 45 removes excessive toner from the development roller 42, thus adjusting the amount of toner transported to the development range α.

Toner remaining on the surface of the development roller 42 that has passed by the doctor blade 45 is transported to the development range α facing the photoreceptor 2 as the development roller 42 rotates. Toner that is not used in image development but has passed through the development range α further passes by the position to contact the entrance seal 47 and is transported to the supply nip β. In the supply nip β, the supply roller 44 removes toner from the development roller 42 and transports the toner.

Next, toner usable in the present embodiment is described in further detail below.

In the prevent embodiment, toner having a higher degree of fluidity suitable for high-speed toner conveyance is preferred. For example, toner usable in the present embodiment has a degree of agglomeration of about 40% or lower under accelerated test conditions described below. The degree of agglomeration under accelerated test conditions means an index representing fluidity of toner.

Specifically, the degree of agglomeration under accelerated test conditions used in this specification can be measured as follows. In measurement, a power tester manufactured by Hosokawa Micron Corporation may be used.

(Measurement Method)

The sample is left in a thermostatic chamber (35±2° C.) for about 24±1 hours. The degree of agglomeration can be measured using the powder tester. Three sieves different in mesh size, for example, 75 μm, 44 μm, and 22 μm are used. The degree of agglomeration can be calculated based on the amount of toner remaining on the sieves using the following formulas, and the sum of the three values obtained using the following formulas is deemed the degree of agglomeration under accelerated test conditions.

[Weight of toner remaining on the upper sieve/amount of sample]×100,

[Weight of toner remaining on the middle sieve/amount of sample]×100×3/5,

[Weight of toner remaining on the lower sieve/amount of sample]×100×1/5

As described above, the degree of agglomeration under accelerated test conditions used here is an index obtained from the weight of toner remaining on the three sieves different in mesh size after the sieves are stacked in the order of mesh roughness (with the sieve of largest mesh at the lowest), toner particles are put in the sieve on the top, and constant vibration is applied thereto.

Additionally, the mean circularity of toner usable in the present embodiment can be 0.90 or greater (up to 1.00). In the present embodiment, the value obtained from the formula below is regarded as circularity a. The circularity herein means an index representing surface irregularity rate of toner particles. Toner particles are perfect spheres when the circularity thereof is 1.00. As the surface irregularity increases, the degree of circularity decreases. In the formula below, $L_0$ represents a circumferential length of a circle having an area identical to that of projected image of a toner particle, and L represents a circumferential length of the projected image of the toner particle.

Circularity $a=L_0/L$

When the mean circularity is within a range of from 0.90 to 1.00, toner particles have smooth surfaces, and contact areas among toner particles and those between toner particles and the photoreceptor 2 are small, attaining good transfer performance.

When the mean circularity is within a range from 0.90 to 1.00, the toner particle does not have a sharp corner, and torque of agitation of toner inside the development device 4 can be smaller. Accordingly, driving of agitation can be reliable, preventing or reducing image failure.

Further, since toner particles forming dots do not include any angular toner particle, pressure can be applied to toner particles uniformly when toner particles are pressed against recording media in image transfer. This can inhibit toner particles failing to be transferred to the recording medium.

Moreover, since toner particles are not angular, grinding force of toner particles thereof can be smaller, scratches on the surfaces of the photoreceptor 2, the charging member 3, and the like can be reduced. Thus, damage or wear of those components can be alleviated.

A measurement method of circularity is described below.

Circularity can be measured by a flow-type particle image analyzer FPIA-1000 from SYSMEX CORPORATION. More specifically, as a dispersant, 0.1 ml to 0.5 ml of surfactant (preferably, alkylbenzene sulfonate) is put in 100 ml to 150 ml of water from which impure solid materials are previously removed, and 0.1 g to 0.5 g of the sample (toner) is added to the mixture. The mixture including the sample is dispersed by an ultrasonic disperser for 1 to 3 min to prepare a dispersion liquid having a concentration of from 3,000 to 10,000 pieces/μl, and the toner shape and distribution are measured using the above-mentioned instrument.

To attain fine dots of 600 dpi or greater, it is preferable that the toner particles have the weight average particle size (D4) within a range from 3 μm to 8 μm. Within this range, the particle diameter of toner particles are small sufficiently for attaining good microscopic dot reproducibility. When the weight average particle size (D4) is less than 3 μm, transfer efficiency and cleaning performance can drop.

By contrast, when the weight average particle size (D4) is greater than 8 μm, it is difficult to prevent scattering of toner around letters or thin lines in output images. Additionally, the ratio of the weight average particle diameter (D4) to the number average particle diameter (D1) is within a range of from 1.00 to 1.40 (Dv/Dn). As the ratio (D4/D1) becomes closer to 1.00, the particle diameter distribution becomes sharper. In the case of toner having such a small diameter and a narrow particle diameter distribution, the distribution of electrical charge can be uniform, and thus high-quality image with scattering of toner in the backgrounds reduced can be produced. Further, in electrostatic transfer methods, the transfer ratio can be improved.

Measurement of particle diameter distribution is described below.

The particle diameter distribution of toner can be measured as follows using a Coulter counter TA-II or Coulter Multisizer II from Beckman Coulter, Inc.

Initially, 0.1 ml to 5 ml of surfactant, preferably alkylbenzene sulfonate, is added as dispersant to 100 ml to 150 ml of electrolyte. Usable electrolytes include ISOTON-II from Coulter Scientific Japan, Ltd., which is a NaCl aqueous solution including an primary sodium chloride of 1%. Then, 2 mg to 20 mg of the sample (toner) is added to the electrolyte solution. The sample suspended in the electrolyte solution is dispersed by an ultrasonic disperser for about 1 to 3 min to prepare a sample dispersion liquid. Weight and number of toner particles for each of the following channels are measured by the above-mentioned measurer using an aperture of 100 μm to determine a weight distribution and a number distribution. The weight average particle size (D4) and the number average particle diameter (D1) can be obtained from the distribution thus determined.

The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The range to be measured is set from 2.00 μm to less than 40.30 μm.

The toner preferably used in the present embodiment is obtained by cross-linking reaction and/or an elongation reaction of a toner constituent liquid in an aqueous solvent. Here, the toner constituent liquid is prepared by dispersing a polyester prepolymer including a functional group having at least a nitrogen atom, a polyester, a colorant, and a releasing agent in an organic solvent. Such toner is called polymerized toner. A description is now given of toner constituents and a method for manufacturing toner.

(Polyester)

The polyester is prepared by a polycondensation reaction between a polyalcohol compound and a polycarboxylic acid compound. Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH].

The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and low-temperature fixability of the toner on the recording paper improves. However, when the acid value is too large, the resultant toner is not stably charged and the stability becomes worse by environmental variations.

The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, low-temperature fixability thereof deteriorates.

The polyester preferably includes urea-modified polyester as well as unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof.

Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α,α,α',α'-tetramethyl xylylene diisocyanate), isocyanurates, materials blocked against the polyisocyanate with phenol derivatives, oxime, caprolactam or the like, and combinations of two or more of the above-described materials.

The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 and 1.2/1, and more preferably between 2.5/1 and 1.5/1. When [NCO]/[OH] is too large, for example, greater than 5, low-temperature fixability of the resultant toner deteriorates. When [NCO]/[OH] is too small, for example, less than 1, a urea content in ester of the modified polyester decreases and hot offset resistance of the resultant toner deteriorates.

The polyester prepolymer (A) typically includes a polyisocyanate group of from 0.5 to 40% by weight, preferably from 1 to 30% by weight, and more preferably from 2 to 20% by weight. When the content is too small, for example, less than 0.5% by weight, hot offset resistance of the resultant toner deteriorates, and in addition, the heat resistance and low-temperature fixability of the toner also deteriorate. By contrast, when the content is too large, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4"-diaminodiphenyl methane), alicyclic diamines (e.g., 4,4"-diamino-3,3"-dimethyldicyclohexylmethane, diamine cyclohexane, and isophoron diamine), and aliphatic diamines (e.g., ethylene diamine, tetramethylene diamine, and hexamethylene diamine).

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propioic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2.

When the mixing ratio is too large or small, molecular weight of the urea-modified polyester decreases, resulting in deterioration of hot offset resistance of the toner. The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, for example, less than 10%, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Suitable solvents include solvents which do not react with polyvalent polyisocyanate compound (PIC). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full-color images deteriorate.

A combination of the urea-modified polyester and the unmodified polyester improves low temperature fixability of the resultant toner and glossiness of full-color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, for example, lower than 45° C., the high temperature preservability of the toner deteriorates. By contrast, when the glass transition temperature is too high, for example, higher than 65° C., the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for toner usable in the present embodiment include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant usable in the present embodiment can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner usable in the present embodiment optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity. Accordingly, the electrostatic attraction of the developing roller 42 attracting toner increases, thus degrading fluidity of toner and image density.

(Release Agent)

When wax having a low melting point of from 50° C. to 120° C. is use in toner as a release agent, the wax can be dispersed in the binder resin and serve as a release agent at an interface between the fixing roller of the fixing device 12 and toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to improve the fluidity, developing property and charging ability of the toner particles. Preferable external additives include inorganic fine particles. The inorganic fine particles preferably have a primary particle diameter of from $5\times10^{-3}$ μm to 2 μm, and more preferably from $5\times10^{-3}$ μm to 0.5 μm. In addition, the inorganic fine particles preferably has a specific surface area measured by a BET method of from 20 to 500 $m^2/g$. The content of the external additive is preferably from 0.01 to 5% by weight, and more preferably from 0.01 to 2.0% by weight, based on total weight of the toner composition.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-2}$ μm considerably improves an electrostatic force between the toner particles and van der Waals force. Accordingly, the resultant toner composition has a proper charge quantity. In addition, even when the toner composition is agitated in the developing devices 5, the external additive is hardly released from the toner particles. As a result, image defects such as white spots and image omissions are hardly produced. Further, the amount of residual toner after transfer can be reduced.

When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles.

The amount in total of hydrophobic silica fine particles and hydrophobic titanium oxide fine particles added is preferably from 0.3 to 1.5% by weight based on weight of the toner particles to reliably form high-quality images without degrading charge rising properties even when images are repeatedly copied.

A method for manufacturing the toner is described in detail below, but is not limited thereto.

(Toner Manufacturing Method)

(1) The colorant, the unmodified polyester, the polyester prepolymer having an isocyanate group, and the release agent are dispersed in an organic solvent to obtain toner constituent liquid. Volatile organic solvents having a boiling point lower than 100° C. are preferable because such organic solvents can be removed easily after formation of parent toner particles. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein. Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi (aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4)sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd.

In addition, inorganic dispersants such as tricalcium phosphate, calcium carbonate, titanium oxide, colloidal silica, and hydroxy apatite can also be used.

As dispersants usable in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nigtroge-containing compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group. This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle. The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well known methods using a mixer or the like are used to provide the charge control agent and to add the inorganic fine particles. Accordingly, toner having a smaller particle diameter and a sharper particle diameter distribution can be easily obtained. Further, strong agitation in removal of the organic solvent can cause toner particles to have a shape between a spherical shape and a spindle shape, and surface morphology between a smooth surface and a rough surface.

Development rollers for use in one-component development devices may have a surface abraded by sandblasting or the like to improve capability to carry toner on the development roller and transport thereby. However, surface unevenness formed by sandblasting or the like is typically irregular, creating projections and recesses different in height and depth and arranged unevenly, and it is possible that such irregular surface unevenness causes the amount of toner carried on the development roller to fluctuate, resulting in unevenness in image density.

By contrast, in the development device 4 according to the first embodiment, the development roller 42 has regular surface unevenness as described above. That is, the multiple projections 42*a* having a substantially identical height and the recesses 42*b* having a substantially identical depth (W3) are formed in the surface of the development roller 42 regularly. Accordingly, the amount of toner carried thereon can be constant, inhibiting image density unevenness.

The term "regular surface unevenness" used in this specification means projections and recesses formed in succession to an extent that the amount of toner adhering thereto is substantially uniform to inhibit image density unevenness.

Alternatively, applicable surface irregularity arrangements can be described as follows, focusing on the latent image formed on the photoreceptor 2. For example, the latent image consists of multiple dot-like latent images formed in respective regions separated by a grid that can be formed at multiple different pitches in the axial direction, and, on the back side in the axial direction (back side of the apparatus), the grid is formed at pitches shorter than the longest pitch among the multiple different pitches.

It is to be noted that effects of the first embodiment, described in detail later, can be attained also in configurations in which the surface unevenness of the development roller 42 is not in regular arrangement. However, regular arrangement of surface unevenness is preferable in light of image quality.

The direction of rotation of the development roller 42 in the toner regulation range is described below.

Figure 40:
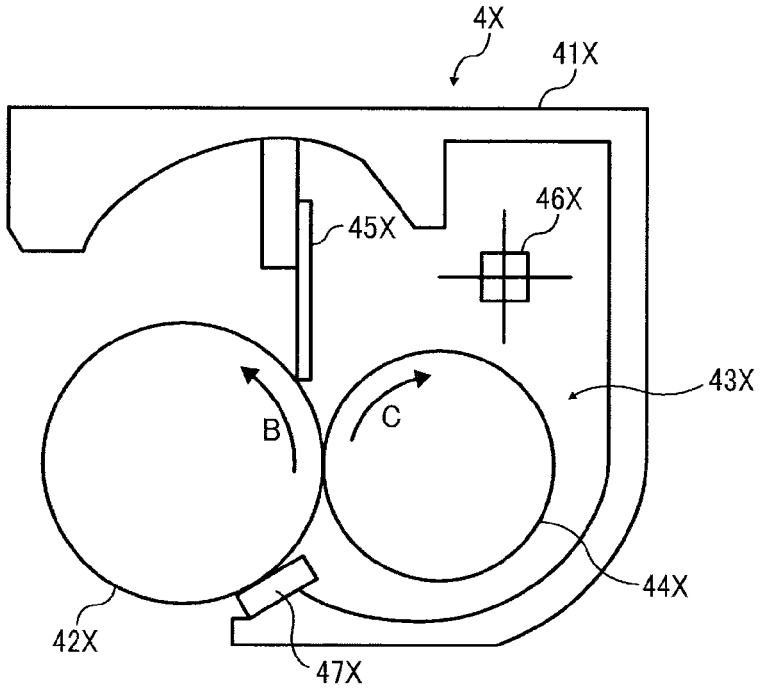
FIG. 40 is an end-on axial view of a development device according to a comparative example.
Figure 41:
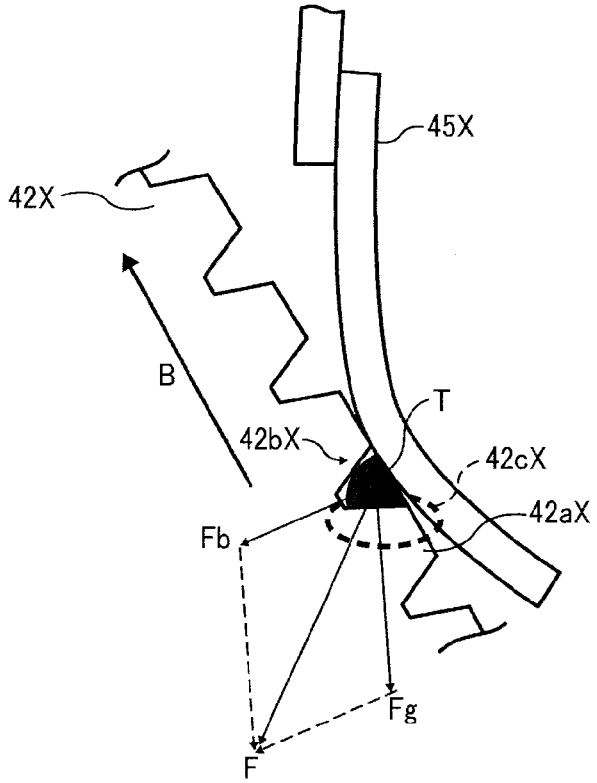
FIG. 41 is an enlarged view around a toner regulation range in the comparative development device shown in FIG. 41.

FIG. 40 is a schematic end-on axial view of a comparative development device 4X, and FIG. 41 is an enlarged view around a toner regulation range in the comparative development device 4X. It is to be noted that, other than the difference described below, configuration and operation of components of the comparative development device 4X are similar to those according to the present embodiment, and reference suffix "X" is added to the reference characters representing those components in FIGS. 40 and 41.

In FIG. 41, arrow B indicates the direction of rotation of the development roller 42X, Fg represents a force resulting from a self weight of toner inside the recesses 42*b*X, and Fb represents a stress caused by the doctor blade 45X that contacts the development roller 42X and then is curved to the right in FIG. 41. Additionally, arrow F represents a resultant of the force Fg and the stress Fb.

As shown in FIGS. 40 and 41, in the comparative development device 4X, the development roller 42X, which rotates in the direction B, moves upward in the toner regulation range where the amount of toner is adjusted. If the development roller 42X moves upward at the position where the development roller 42X contacts the doctor blade 45X as in the comparative example, toner receives the downward force Fg under weight of toner itself, which can increase the compression force exerted on toner due to the stress Fb of the doctor blade 45X. Increases in the compression force is not desirable because it increases the possibility of coagulation of toner in a downstream portion 42*c*X of the projection 42*a*X in the direction B and the possibility of toner filming on the development roller 42X. Toner filming can reduce the toner charge amount Q per unit weight M (Q/M) as well as the toner amount M carried on the roller unit area A (M/A).

Figure 20:
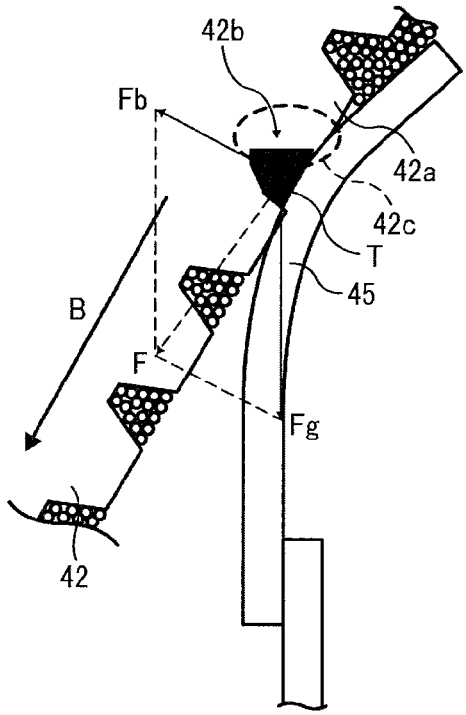
FIG. 20 is an enlarged view of a toner regulation range in which a planar portion of the doctor blade contacts the development roller (planar contact)

By contrast, in the development device 4 according to the first embodiment, as shown in FIGS. 1 and 20, the development roller 42, which rotates in the direction B, moves downward in the toner regulation range where the development roller 42 faces the doctor blade 45. FIG. 20 is an enlarged view of the toner regulation range in the development device 4 according to the first embodiment. In FIG. 20, arrows B, Fg, Fb, and F represent the respective forces described above with reference to FIG. 41.

In this case, the downward force Fg (shown in FIG. 20) acting on toner under weight of toner itself can reduce compression force due to a stress Fb of the doctor blade 45. This configuration can inhibit aggregation of toner in the downstream portion 42*c* in FIG. 20 of the projection 42*a* in the direction B in which the development roller 42 rotates. Consequently, creation of toner filming can be inhibited, and fluctuations in the charge amount Q per unit volume M (Q/M) as well as the toner amount M carried on the roller unit area A (M/A) can be reduced.

Figure 21:
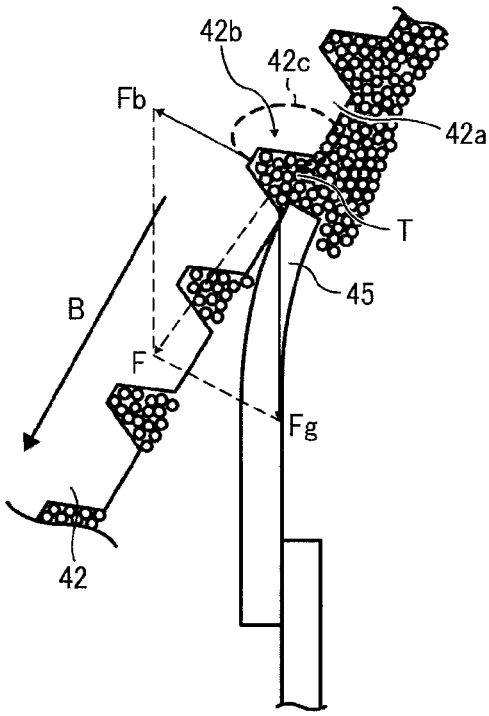
FIG. 21 is an enlarged view of a toner regulation range in which an edge portion of the doctor blade contacts the development roller (edge contact state)

Additionally, use of toner whose degree of agglomeration under the above-described accelerated test conditions is 40% or lower can alleviate coagulation of toner in the downstream portion 42*c* (shown in FIG. 20) of the projection 42*a* formed in the surface of the development roller 42. It is to be noted that, in FIG. 20, the doctor blade 45 is in planar contact with the development roller 42. Regarding the contact state of the doctor blade 45 with the development roller 42, the edge contact state shown in FIG. 21 is advantageous in that toner T present on the top face 42*t* of the projection 42*a* can be leveled off.

Figure 22:
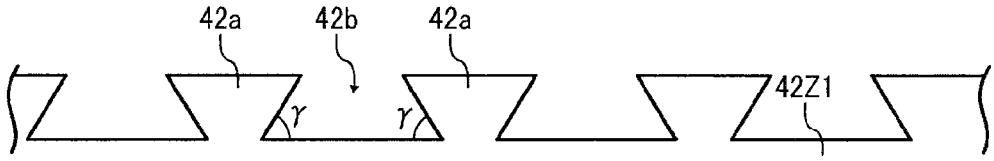
FIG. 22 is an enlarged cross-sectional view illustrating a surface of a development roller in which angles formed by projections and recesses are smaller than 90°.
Figure 23:
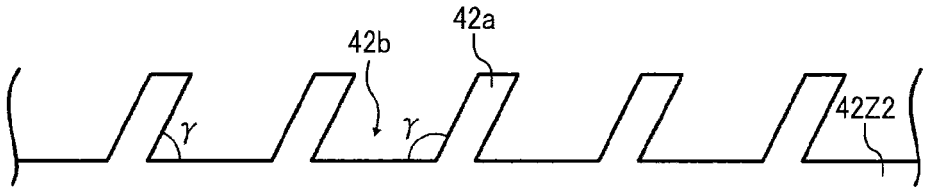
FIG. 23 is an enlarged cross-sectional view illustrating a surface of a development roller in which a part of angles formed by projections and recesses are smaller than 90°.

FIGS. 22 and 23 illustrate surfaces of comparative development rollers 42Z1 and 42Z2.

As shown in FIG. 22, when angles γ formed by the projections 42*a* and the recesses 42*b* are smaller than 90°, the possibility that the supply roller 44 can contact the recesses 42*b* entirely can decrease. Similarly, when some of the angles formed by the projections 42*a* and the recesses 42*b* are smaller than 90° as shown in FIG. 23, the possibility that the supply roller 44 can contact the recesses 42*b* entirely can decrease.

Figure 24:
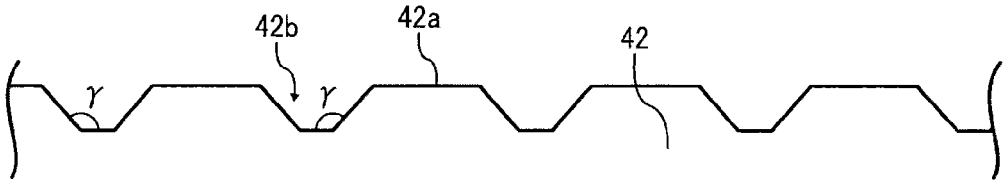
FIG. 24 is an enlarged cross-sectional view illustrating a surface of a development roller in which angles formed by projections and recesses are equal to or greater than 90°.

By contrast, in the first embodiment, as shown in FIG. 24, the angles γ formed by the projections 42*a* and the recesses 42*b* are equal to or greater than 90°. The configuration shown in FIG. 24 in which the angles γ are equal to or greater than 90° can increase the possibility that the supply roller 44 can contact toner carried on the development roller 42, thereby facilitating reset of toner.

Figure 25:
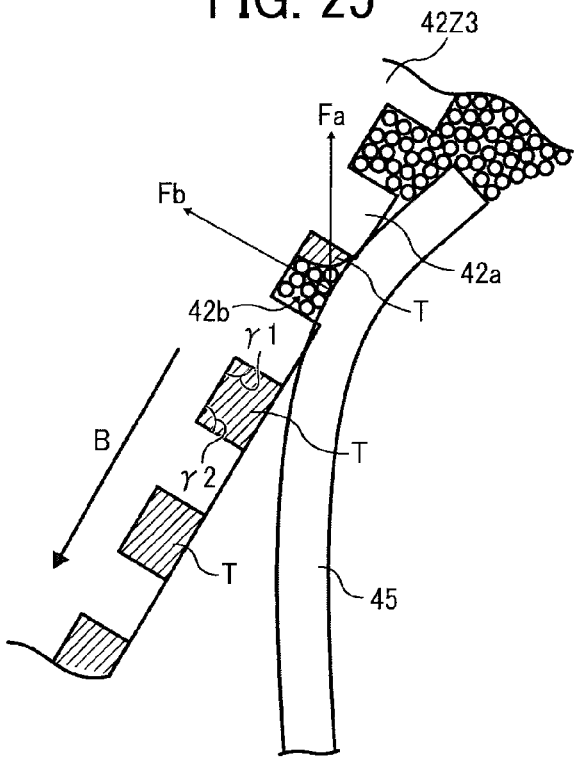
FIG. 25 is an enlarged cross-sectional view illustrating a surface of a development roller in which angles formed by projections and recesses are 90°.

FIG. 25 illustrates a comparative development roller 42Z3 in which the angles γ formed on both a downstream side and an upstream side of each projection 42*a* in the direction B in which the development roller 42 rotates are 90°. In FIG. 25, reference characters γ1 represents the angle formed by the downstream side of the projection 42*a* and the recess 42*b* (hereinafter "downstream angle γ1") and γ2 represents the angle formed by the upstream side of the projection 42*a* and the recess 42*b* (hereinafter "upstream angle γ2").

In the comparative configuration shown in FIG. 25, the stress of the doctor blade 45 acts in the direction indicated by arrow Fb. Since the development roller 42Z3 rotates in the direction B, toner T held in the recesses 42*b* receives the compression force in the direction indicated by arrow Fa due the stress of the doctor blade 45 in the direction Fb. Therefore, if the toner particles in contact with the downstream side of the projections 42*a* in the direction B are not replaced, the compression force can be repeatedly applied to identical toner particles, causing the toner particles to coagulate.

Figure 26:
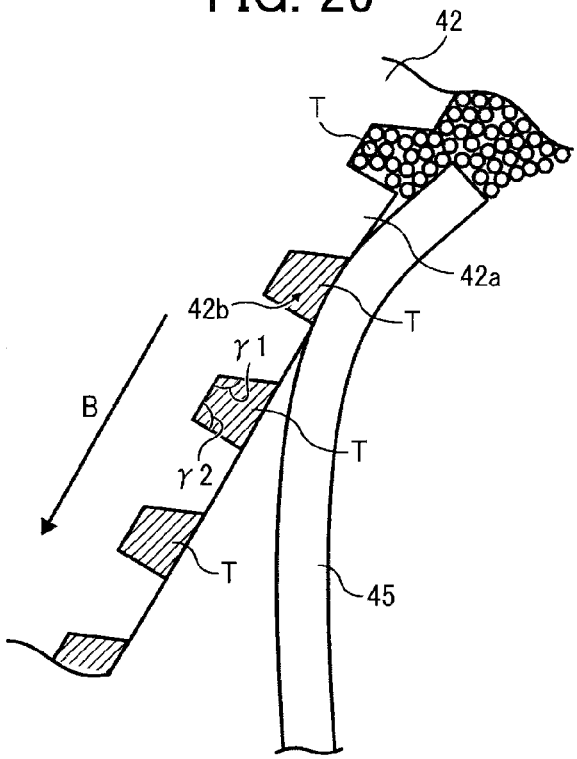
FIG. 26 is an enlarged cross-sectional view illustrating a surface of a development roller in which projections and recesses form obtuse angles and the doctor blade is in a planar contact state.

By contrast, in the first embodiment, among the angles γ formed by the projections 42*a* and the recesses 42*b*, at least the downstream angles γ1 are obtuse as shown in FIG. 26.

When the downstream angle γ1 is thus obtuse, the supply roller 44 can better remove toner particles in contact with the downstream side of the projection 42*a* in the direction B, thus facilitating replacement of toner particles. Accordingly, compression force is not repeatedly applied to specific toner particles, thereby inhibiting coagulation of toner particles.

Figure 27:
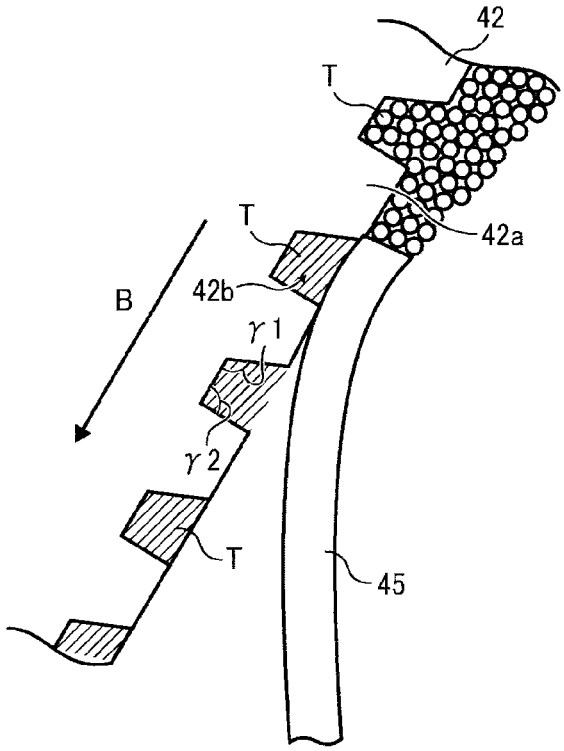
FIG. 27 is an enlarged cross-sectional view illustrating a surface of a development roller in which some of angles formed by projections and recesses are obtuse and the doctor blade is in edge contact state.

It is to be noted that, in the enlarged cross-sectional view shown in FIG. 26, the doctor blade 45 is in planar contact with the development roller 42. Regarding the contact state of the doctor blade 45 with the development roller 42, the edge contact state shown in FIG. 27 is advantageous in that toner T present on the top face 42*t* of the projection 42*a* can be leveled off.

Figure 28:
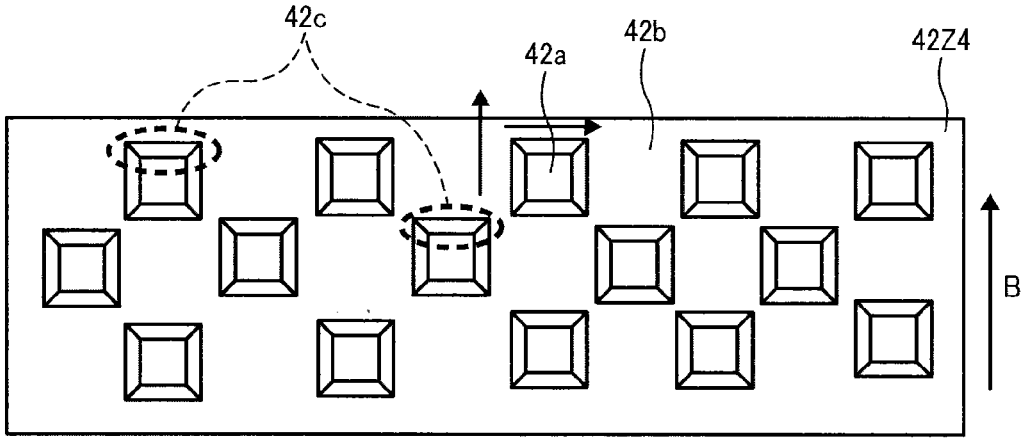
FIG. 28 is an enlarge view of a configuration in which a top face of each projection formed in the surface of the development roller has a pair of sides parallel to the direction of rotation of the development roller.

FIG. 28 illustrates another comparative development roller 42Z4 having a surface in which rhombic or diamond projections 42*a* are formed. When one of two pairs of parallel sides of the top face 42*t* of each projection 42*a* parallels the direction B in which the development roller 42Z4 rotates as in the configuration shown in FIG. 28, toner is likely to coagulate in the downstream portion 42*c* of the projection 42*a* in the direction B, thus increasing filming.

By contrast, in the first embodiment, the top face 42*t* of the projection 42*a* has two pairs of parallel sides both oblique to the direction B in which the development roller 42 rotates as shown in (b) of FIG. 13. In this configuration, the direction in which the doctor blade 45 slidingly contacts the projections 42*a* can be oblique to the two pairs of parallel sides of the top face 42*t* of each projection 42*a*. Accordingly, toner is not easily compressed in the downstream portion 42*c* (shown in FIG. 13) in the direction B. In the first embodiment, the sides of the diamond-shaped top face 42*t* of each projection 42*a* can be at an angle of 45° to the direction B in which the development roller 42 rotates, for example.

Next, a distinctive feature of the present embodiment is described below.

In the development device 4 according to the first embodiment, a metal blade is used as the doctor blade 45 (blade 450).

Resin or rubber blades are often used as the developer regulator disposed to contact the development roller having regular surface unevenness, that is, regularly arranged projections and recesses. However, in the case of rubber blades, it is possible that the amount by which the developer regulator projects from the fixed portion of the developer regulator (e.g., the portion held by the blade holder 45*c*), which is hereinafter referred to as "projecting amount of the developer regulator (or doctor blade), fluctuates due to tolerance in manufacturing or assembling, or abrasion of the developer regulator over repeated use. As a result, the amount of toner carried on the development roller fluctuates. Specifically, it is possible that the amount of toner carried on the development roller may be extremely small, making image density too light, or that the mount of toner is excessive and causes defective toner charging, resulting in scattering of toner on the background of output images.

By contrast, when a metal blade is used as the doctor blade 45 as in the first embodiment, the amount of toner carried on the development roller 42 can be kept substantially constant even if the projecting amount of the doctor blade 45 fluctuates in a certain range.

For the development roller 42, general purpose materials such as, but not limited to, carbon steel (such as STKM, JIS standard), aluminum, or SUS steel can be used. Examples of materials usable for the doctor blade 45 include, but not limited to, phosphor bronze such as C5210, copper such as C1202, beryllium copper such as C1720, and stainless steel such as SUS301 and SUS304.

EXPERIMENT 1

Descriptions are given below of experiment 1 performed to examine changes in the amount of toner carried on the development roller 42 depending on the projecting amount of the doctor blade 45 in cases of the metal doctor blade 45 and a rubber doctor blade as a comparative example.

Figure 29A:
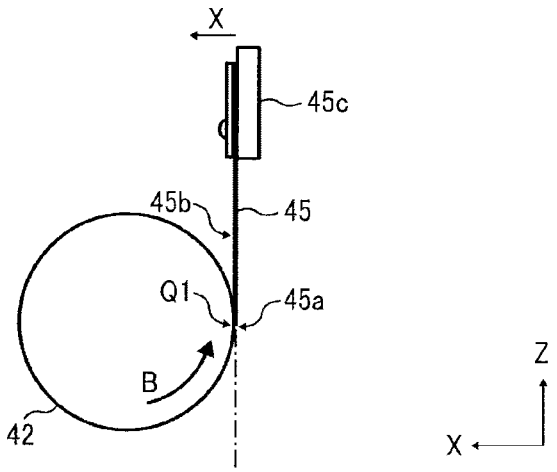
FIG. 29A illustrates a configuration in which the doctor blade contacts the development roller in a direction tangential to the development roller.
Figure 29B:
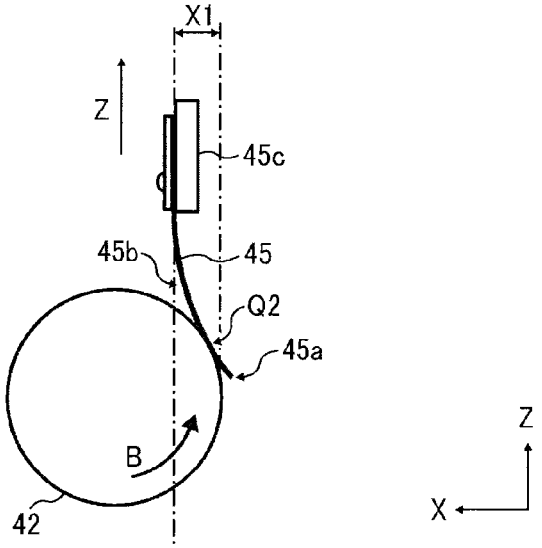
FIG. 29B illustrates a state in which a doctor holder is moved in a normal direction from the state shown in FIG. 29A.
Figure 29C:
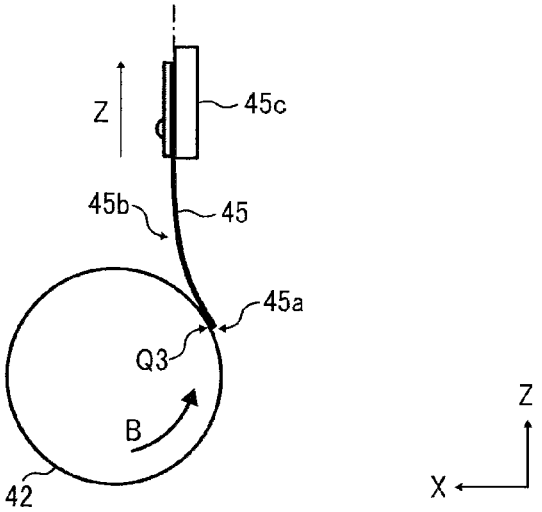
FIG. 29C illustrates a state in which the doctor holder is moved in the tangential direction from the state shown in FIG. 29C.

Referring to FIGS. 29A, 29B, and 29C, the projecting amount of the doctor blade 45 can be changed in the following manner.

Initially, the doctor blade 45 is disposed in the edge contact state with the development roller 42 such that the doctor blade 45 extends in the vertical direction in FIG. 29A, which is tangential to the development roller 42 at an initial contact position Q1 between the doctor blade 45 and the development roller 42. The term "edge contact state" used here means a state in which an edge defining a ridgeline between an end face 45*a* and an opposed face 45*b* of the doctor blade 45 (on the side facing the development roller 42) or a portion adjacent to the edge (i.e., corner portion 45*e* shown in FIG. 31) contacts the surface of the development roller 42, more particularly, the top face 42*t* of the projections 42*a*. The edge portion 45*e* is adjacent to a virtual line (corner) where a virtual plane extending along the opposed face 45*b* crosses a virtual plane extending along the end face 45*a*. It is not necessary that the edge portion 45*e* defining the ridgeline around the above-described virtual liner is sharp but can be curved or chamfered.

More specifically, the edge portion 45*e* is a corner portion (sharp, curved, or chamfered) on the free side of the planar doctor blade 45 and on the side facing the development roller 42, and the edge contact state means a state in which the edge portion 45*e* can contact the projections 42*a* of the development roller 42.

Additionally, regarding the direction of edge contact, as shown in FIGS. 1 and 21, the blade holder 45*c*, where the doctor blade 45 is fixed, is positioned downstream from the edge portion of the doctor blade 45 in contact with the development roller 42 in the direction B in which the development roller 42 rotates. That is, the doctor blade 45 is disposed such that the free tip portion thereof is oriented against the rotation of the development roller 42.

It is to be noted that, although a planer doctor blade may be bent into an L-shape so that the bent portion (i.e., a corner) contacts the development roller 42, the above-described edge contact state is preferred because toner can be scraped off better. Thus, the doctor blade 45 projects from the downstream side to the upstream side in the direction B to be in the edge contact state.

Referring back to the manner to change the projecting amount of the doctor blade 45, from the state shown in FIG. 29A, the blade holder 45*c* (pedestal 452) supporting the base portion of the doctor blade 45 is moved a distance X1 (hereinafter "shift distance X1") toward the development roller 42 in direction X shown in FIG. 29A, that is, a normal direction to the development roller 42 at the initial contact position Q1. Then, as shown in FIG. 29B, the doctor blade 45 contacts the development roller 42 at a position shifted from the edge portion to the base portion. Further, the doctor blade 45 deforms and warped, resulting in the planar contact state. The planar contact state here means that a portion of the opposed face 45*b* contacts the development roller 42 and the edge portion (45*e* in FIG. 31) does not contact the doctor blade 45. At that time, the contact position of the doctor blade 45 with development roller 42 is moved upward from the initial contact position Q1 to a contact position Q2.

When the blade holder 45*c* is moved from the position shown in FIG. 29B away from the development roller 42 in the vertical direction (direction Z) in FIG. 29B perpendicular to the normal direction at the initial contact position Q1, the projecting amount of the doctor blade 45 decreases gradually. When the blade holder 45*c* is moved to the position shown in FIG. 29C, the doctor blade 45 is in the edge contact state (at a contact position Q3) and simultaneously warped or deformed. When the blade holder 45*c* is moved further in the direction Z from the position shown in FIG. 29C to gradually reduce the projecting amount of the doctor blade 45, the edge contact can be kept with deformation amount of the doctor blade 45 reduced until the doctor blade 45 is disengaged from the development roller 42.

Figure 30:
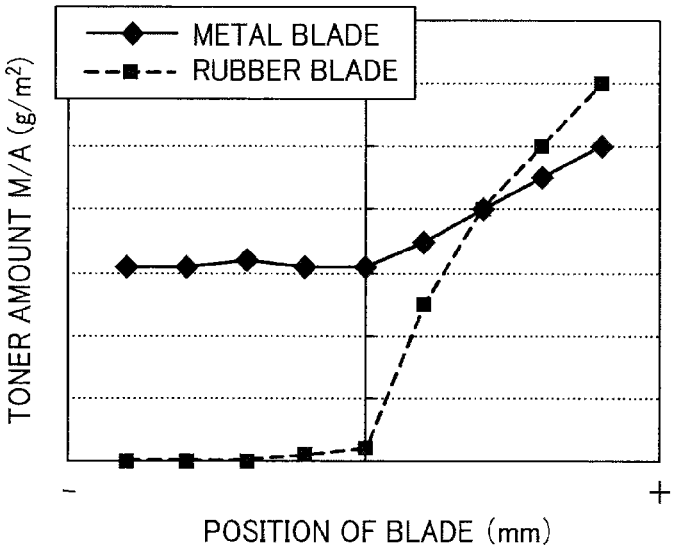
FIG. 30 is a graph illustrating results of experiment 1.

FIG. 30 is a graph illustrating changes in the amount of toner carried on and transported by the development roller 42 when the projecting amount of the doctor blade 45 is changed as shown in FIGS. 29A through 29C in cases of the metal doctor blade 45 constructed of phosphor bronze and the comparative rubber doctor blade.

In the graph shown in FIG. 30, the position of the doctor blade 45 shown in FIG. 29C is deemed zero point, at which the doctor blade 45 is in the edge contact state changed from the planar contact state shown in FIG. 29B. Moving the blade holder 45*c* from zero point in the direction Z in FIGS. 29A to 29C causes minus displacement, and moving the blade holder 45*c* from zero point in the opposite direction causes plus displacement. In other words, the projecting amount of the doctor blade 45 increases to the right in FIG. 30. In FIG. 30, the results in the case of the rubber doctor blade are plotted with broken lines, and the results in the case of the metal doctor blade 45 are plotted with a solid line.

Referring to FIG. 30, the amount of toner transported increased as the displacement increased in plus direction in both cases of the metal doctor blade 45 and the rubber doctor blade.

By contrast, when the position of the doctor blade 45 was in minus direction, the amount of toner transported by the metal doctor blade 45 (solid line) was constant in a certain range. However, when the position of the rubber doctor blade was in minus direction, toner was rarely transported by the development roller 42 as indicated by broken lines shown in FIG. 30.

As can be known form the results of experiment 1 shown in FIG. 30, in the case of the metal doctor blade 45, a desired amount of toner can be carried on the development roller 42 in a wider range of the amount by which the doctor blade 45 projects relative to the development roller 42.

Consequently, use of metal blades can increase margin in the direction Z of design and positioning of the doctor blade 45, thus facilitating assembling. Further, margin of mechanical tolerance can increase, and the component cost can be reduced.

Figure 31:
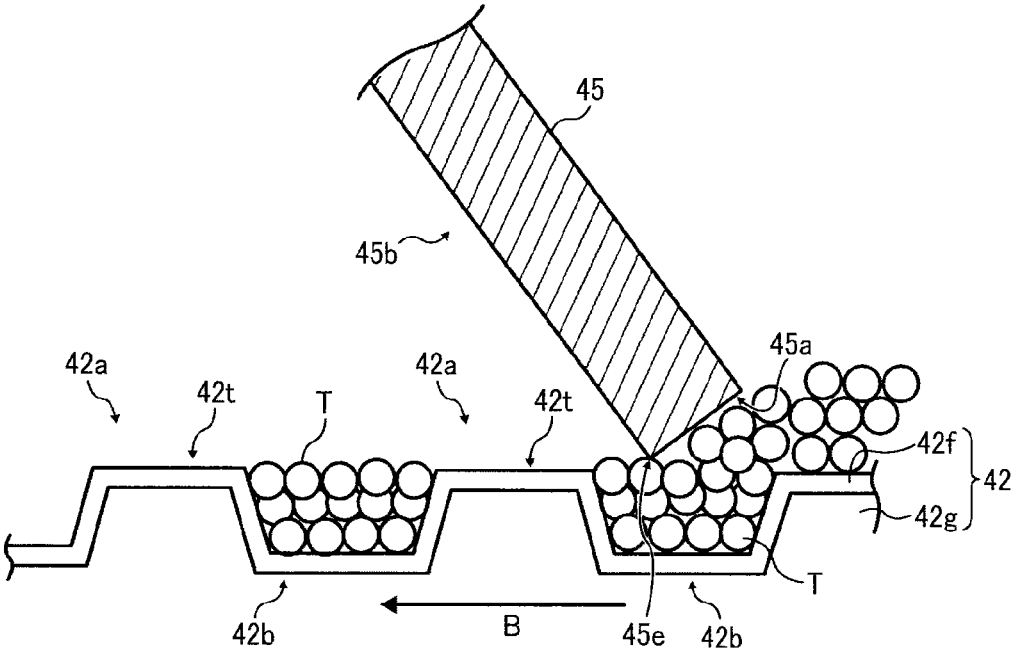
FIG. 31 is an enlarged view of the doctor blade in the edge contact state.

FIG. 31 is an enlarged view illustrating the contact portion between the development roller 42 and the doctor blade 45 being in the edge contact state.

The toner amount can be stable when the projecting amount is a given amount within the range (in minus direction) shown in FIG. 30 because the edge portion 45*e* of the metal doctor blade 45 contacts the development roller 42. More specifically, referring to FIG. 31, when the edge portion 45*e* contacts the development roller 42, the doctor blade 45 scrapes off toner particles T, making a thin toner layer on the development roller 42. Accordingly, only toner particles T buried in the recesses 42*b* are transported on the development roller 42. Thus, the amount of toner carried can correspond to or equal the capacity (volume) of the recesses 42*b*, making it easy to adjust the amount carried thereon as desired and keep the amount of toner transported constant. Additionally, since metal blades have a certain degree of rigidity, the possibility that metal blades extend into the recesses 42*b* and remove toner therefrom due to elasticity thereof, which is not desirable, is lower than resin blades such as rubber blades. Thus, metal blades can stabilize the amount of toner carried on the development roller 42.

EXPERIMENT 2

In experiment 2, a positional range of the metal doctor blade 45 in which the edge contact state is secured was examined while changing the shift distance X1 (shown in FIG. 29B) in normal direction (direction X) at the initial contact position Q1.

Figure 32:
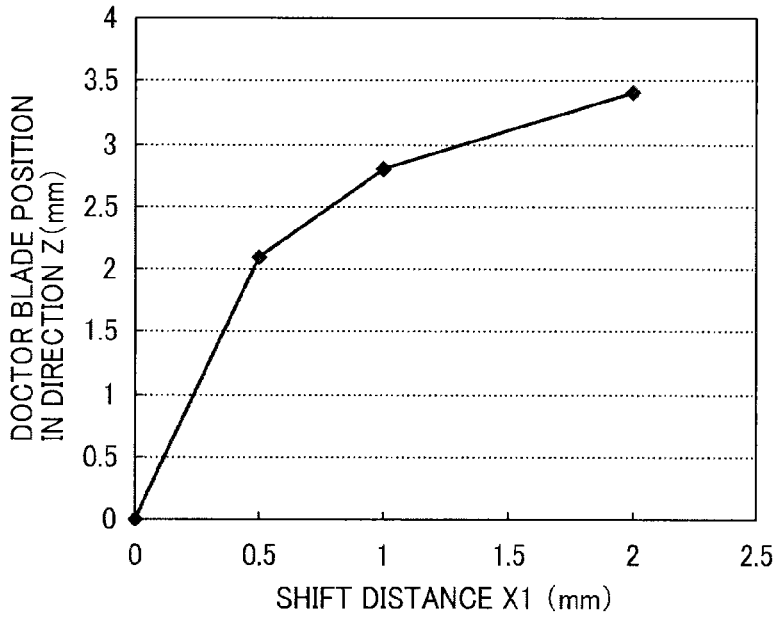
FIG. 32 is a graph illustrating results of experiment 2.

FIG. 32 is a graph illustrating results of experiment 2.

In the graph shown in FIG. 32, the shift distance X1 is deemed zero when the doctor blade 45 is at the initial contact position Q1, that is, the doctor blade 45 is in the direction tangential to the surface of the development roller 42, and the horizontal axis in the graph represents the shift distance X1 as the amount by which the blade holder 45*c* is shifted from the position shown in FIG. 29A to that shown in FIG. 29B. In FIG. 32, zero on the vertical axis represents a state in which the doctor blade 45 is at the contact position Q3 shown in FIG. 29C when the blade holder 45*c* is shifted from the position shown in FIG. 29B in the direction Z. The vertical axis represents the amount by which the blade holder 45*c* is moved in the direction Z from the position shown in FIG. 29C until the doctor blade 45 is disengaged from the surface of the development roller 42. In other words, the vertical axis represents the positional range of the metal doctor blade 45 in which the edge contact state is secured.

As can be known from FIG. 32, when the shift distance X1 is greater than zero, the positional range of the metal doctor blade 45 in which the edge contact state is secured can be expanded as the shift distance X1 increases. When the shift distance X1 is greater than zero, the doctor blade 45 is warped due to the contact with the development roller 42. This arrangement can increase margin in the vertical direction in FIGS. 29A through 29C in design and positioning of the doctor blade 45, thus facilitating assembling. Further, margin of mechanical tolerance can increase, and the component cost can be reduced.

EXPERIMENT 3

Experiment 3 was executed to examine creation of substandard images having streaky unevenness in image density in cases of the doctor blades 45 constructed of phosphor bronze and SUS stainless steel, respectively. In experiment 3, the development roller 42 having a Vickers hardness greater than that of phosphor bronze and smaller than that of stainless steel was used. More specifically, the development roller 42 having an aluminum surface layer was used. It is to be noted that Vickers hardness can be measured according to JIS Z2244 standard.

The Vickers hardness of phosphor bronze used in experiment 3 was 80 Hv. It can be assumed that, the doctor blade 45 constructed of a metal blade having a Vickers hardness lower than 80 Hv can inhibit adhesion of toner similarly to the phosphor bronze doctor blade 45 used in experiment 3. Although Vickers hardness was adopted in experiment 3, Brinell hardness or Rockwell number may be used depending on the material or shape of components.

In experiment 3, the metal blades 45 constructed of the respective materials were disposed in the state shown in FIG. 29C, and solid images printed by the image forming apparatus 500 according to the first embodiment were checked for streaky image density unevenness. In experiment 3, streaky unevenness in image density was not created in the case of phosphor bronze, but created in the case of SUS stainless steel.

Figure 33:
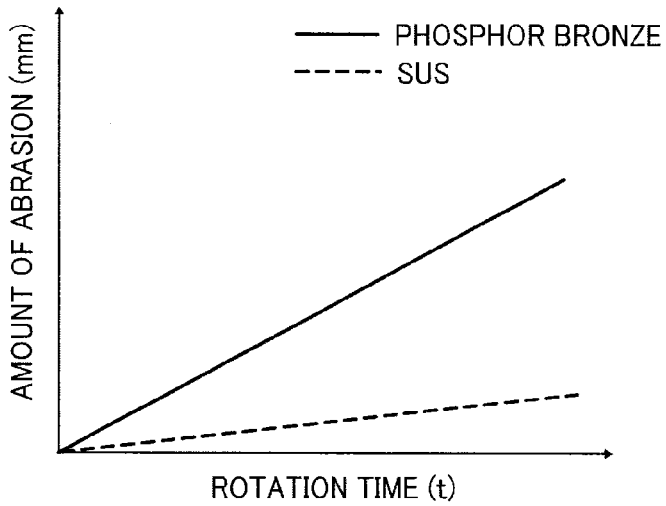
FIG. 33 is a graph of amounts of abrasion of doctor blades different in material.

When the two doctor blades 45 were checked, adhesion of toner was found on the SUS doctor blade 45. By contrast, adhesion of toner was rarely found on the phosphor bronze doctor blade 45. The amount of abrasion of the two doctor blades 45 used in experiment 3 was measured relative to the time during which the development roller 42 was rotated (rotation time of the development roller 42), and FIG. 33 is a graph illustrating the results. In FIG. 33, broken lines represent the amount of abrasion of the SUS blade, and the solid line represents the amount of abrasion of the phosphor bronze blade.

It can be known from FIG. 33 that phosphor bronze can be abraded more easily than SUS stainless steel. It can be deemed that, in the case of the doctor blade 45 constructed of phosphor bronze, even if a small amount of toner adheres to the doctor blade 45, the portion of the doctor blade 45 to which toner adheres can be abraded by sliding contact with the development roller 42 before the adhering toner grows significantly. Accordingly, noticeable streaky unevenness in image density is not caused.

When the surface layer 42*f* of the development roller 42 is harder than the contact portion of the doctor blade 45, the development roller 42 can abrade the doctor blade 45, thus inhibiting adhesion of toner.

To increase the hardness of the surface layer 42*f* of the development roller 42, the development roller 42 may be plated with nickel or the like. Also in configurations in which the surface layer of the development roller 42 is thus hardened, phosphor bronze is preferred as the material of the doctor blade 45 to prevent toner adhesion because phosphor bronze can be abraded more easily than stainless steel. Similarly, metals having a hardness lower than that (such as Vickers hardness of 80 Hv) of phosphor bronze can be effective to prevent adhesion of toner.

As can be known form the results of experiment 3, in the first embodiment, the doctor blade 45 itself is abraded to remove toner adhering thereto while the degree of toner adhesion is lower to inhibit streaky unevenness in image density. Therefore, it is preferred that the doctor blade 45 be abraded entirely in the width direction.

In the development roller 42 according to the first embodiment, in the circumferential direction of the development roller 42, at least one top face 42*t*, which is the highest surface of the projection 42*a*, is present at any position in the width direction (perpendicular to the direction B in which the development roller 42 rotates) in the grooved area 420*a* for carrying toner supplied to the photoreceptor 2.

To satisfy the above-described requirement of the surface unevenness of the development roller 42, the projections 42*a* and the recesses 42*b* are cyclically arranged in the width direction at a given circumferential position (such as line L11 shown in FIG. 13), and at a circumferential position (such as line L12) adjacent to the line L11 in the circumferential direction, the cyclic arrangement of the projections 42*a* and the recesses 42*b* is shifted by a half cycle of this arrangement. In other words, the arrangement cycle of projections 42*a* and the recesses 42*b* on the lines L12 and 14 next to the line 11 and 13 is shifted by a half cycle from the arrangement in the lines L11 and 13. Additionally, the axial length W2 of the top face 42*t* of the projection 42*a* is equal to or greater than the half of the pitch width W1 in the present embodiment. Such surface unevenness is repeatedly formed in the direction B in which the development roller 42 rotates.

With this configuration, when the line L11 of the development roller 42 is at the contact position with the doctor blade 45, there are portions of the doctor blade 45 that do not contact the top faces 42*t*, and such portions contact the top faces 42*t* when the line L12 of the development roller 42 contacts the doctor blade 45. Accordingly, while the development roller 42 makes one rotation, any axial position over the axial length of the doctor blade 45 can contact the top face 42*t* of the development roller 42 at least once. In other words, any axial position of the doctor blade 45 can be efficiently abraded by the top face 42 while the development roller 42 makes one rotation. Thus, streaky image density unevenness resulting from toner adhesion can be prevented securely.

In direct contact development methods in which the surface of the development roller 42 contacts the photoreceptor 2, it is possible that the development roller 42 fails to contact the photoreceptor 2 in some portions depending on manufacturing precision because the development roller 42 and the photoreceptor 2 both have little elasticity. In such portions, toner is not supplied to the photoreceptor 2, resulting in absence of toner in output images. In view of the foregoing, in the first embodiment, the development roller 42 is disposed contactless with, that is, across a gap from, the photoreceptor 2, and the development bias power source 142 applies to the development roller 42 the development bias in which an AC bias is superimposed on a DC bias. Such a development bias can move toner T from the development roller 42 to the photoreceptor 2 as if toner T jumps, thereby developing the latent image formed thereon. Thus, regardless of accuracy in the relative positions of the development roller 42 and the photoreceptor 2, absence of toner in output images can be prevented.

Additionally, the image forming apparatus 500 according to the present embodiment may include an alert system to alert the user when it is time to replace the development device 4, or that the development device 4 is approaching to the end of operational life preliminarily set in accordance with operation conditions.

Figure 34:
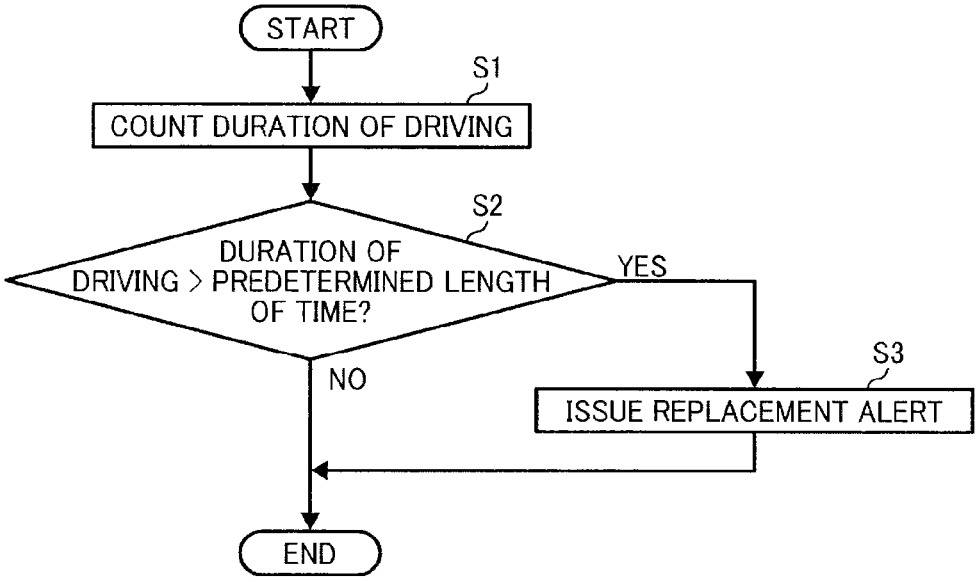
FIG. 34 is a flowchart of alerting to replace the development device.
Figure 35:
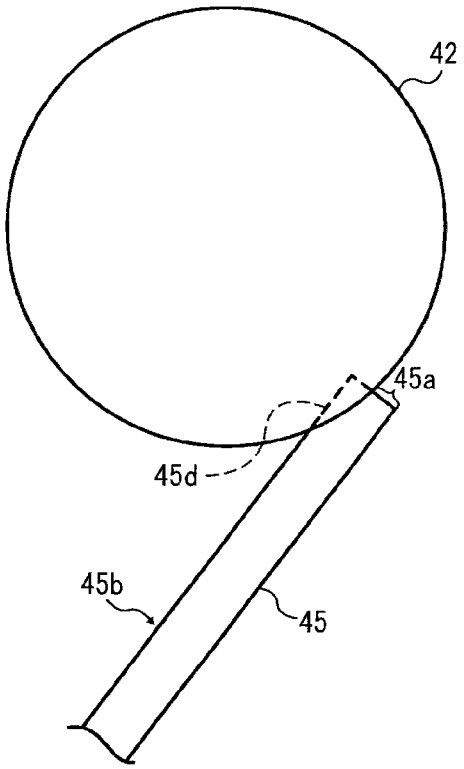
FIG. 35 is an enlarged view of a state of the doctor blade and the development roller of a development device approaching to the end of operational life.

FIG. 34 is a flowchart of alerting the user to replace the development device 4. FIG. 35 is an enlarged view of a state of the doctor blade 45 and the development roller 42 of the development device 4 approaching to the end of operational life.

Referring to FIG. 34, at S1, a parameter for determining the end of operational life is counted. For example, the parameter can be duration of driving of the development device 4. At S2, a controller of the image forming apparatus 500 checks whether or not the duration of driving in total equals to or greater than a predetermined value (i.e., length of time). When the duration of driving reaches the predetermined length of time, (Yes at S2), the controller deems that the development device 4 is at the end of operational life. At S3, the controller alerts it to the user using an alert device such as the alert lamp 501 (shown in FIG. 2) or a liquid crystal display. The parameter according to which the end of operational life is determined can be duration of driving of the development roller 42, the number of sheets, duration of power supply to the development device 4, or combination thereof.

As shown in FIG. 35, a contact portion 45*d* of the doctor blade 45 in edge contact with the development roller 42 is abraded by the development roller 42. It is preferred that the thickness of the doctor blade 45 be determined so that the end face 45*a* remains when the end of the operational life of the device and the necessity of replacement are alerted. Specifically, the thickness of the doctor blade 45 is set in view of a margin for the parameter for determining the end of operational life so that the end face 45*a* still remains when the parameter reaches the value indicating the end of operational life. If the end face 45*a* disappears as the doctor blade 45 is abraded, it is possible that the contact position between the doctor blade 45 and the development roller 42 deviates. Moreover, there is a risk of the sharpened edge of the abraded doctor blade 45 digging in the development roller 42. Therefore, it is preferred that the development device 4 be replaced with the end face 45*a* of the doctor blade 45 remaining.

As described above, the development device 4 according to the first embodiment includes the development roller 42, serving as a developer bearer, that carries by rotation magnetic or nonmagnetic toner as one-component developer and supplies toner to the latent image formed on the photoreceptor 2, serving as the latent image bearer, in the development range a facing the photoreceptor 2. The development device 4 further includes the doctor blade 45 that can be a planar member serving as the developer regulator and having the base end supported by the blade holder 45*c* and the free end portion disposed in contact with the development roller 42 to adjust the amount of toner supplied to the development range α. Further, the projections 42*a* and the recesses 42*b* are formed in the surface of the development roller 42. The doctor blade 45 (or the blade 450) is constructed of metal, and the edge portion 45*e* thereof contacts the surface of the development roller 42.

It is preferable that the portion of the metal doctor blade 45 that contacts the development roller 42 has a degree of hardness lower than that of the development roller 42.

(Second Embodiment)

An image forming apparatus 600 according to a second embodiment is described below. For example, the image forming apparatus in the present embodiment is an electrophotographic printer.

Figure 36:
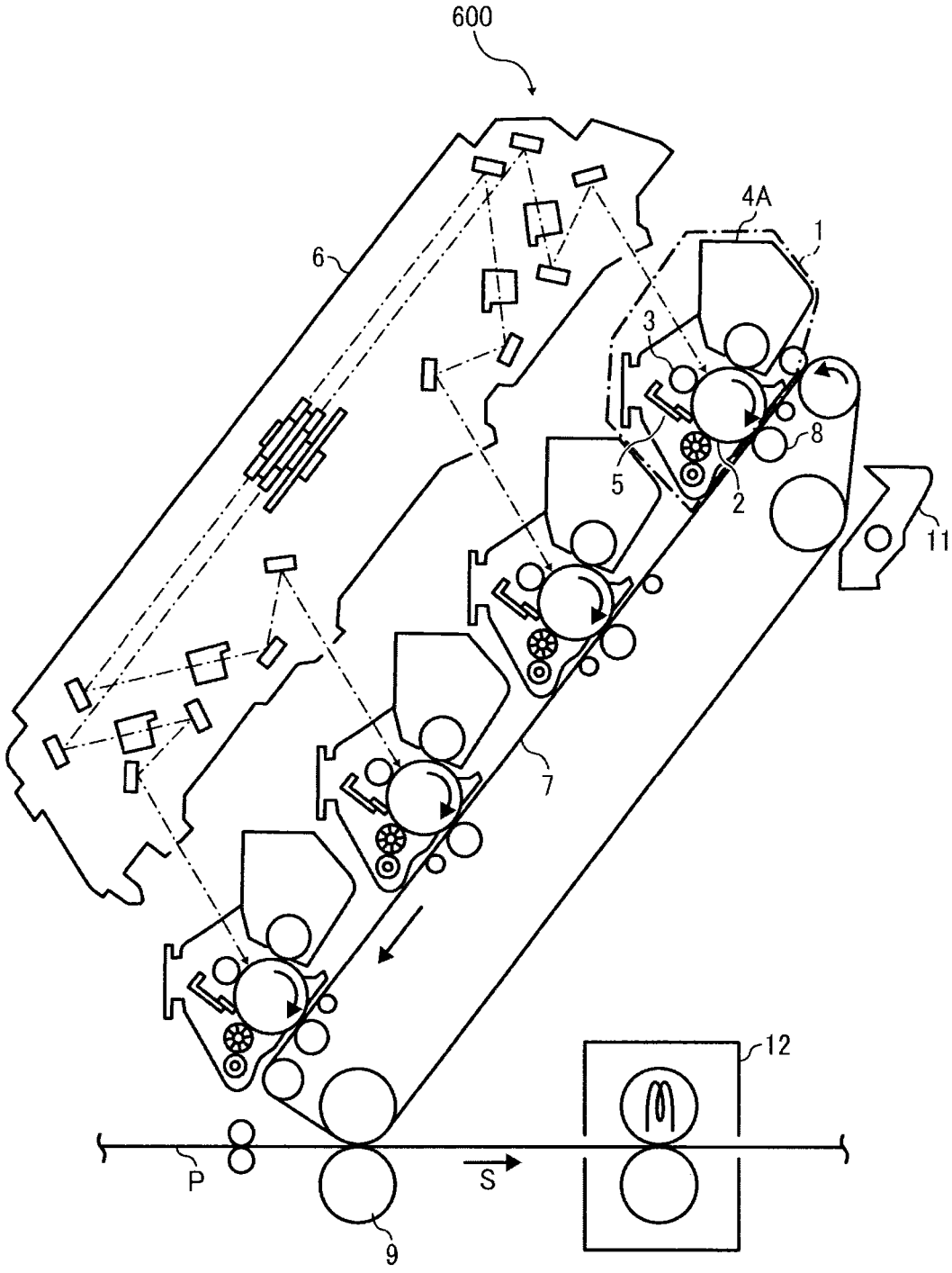
FIG. 36 is a cross-sectional view illustrating a main portion of an image forming apparatus according to a second embodiment.

FIG. 36 is a cross-sectional view illustrating a main portion of the image forming apparatus 600 according to the second embodiment.

As shown in FIG. 36, the image forming apparatus 600 includes four process cartridges 1, an intermediate transfer belt 7 serving as an intermediate transfer member, an exposure unit 6, and a fixing device 12. These components have configurations similar to configurations of those in the first embodiment and operate similarly, and thus descriptions thereof omitted.

Each process cartridge 1 includes a drum-shaped photoreceptor 2, a charging member 3, a development device 4A, and a drum cleaning unit 5, and these components are housed in a common unit casing, thus forming a modular unit. Except the development device 4A, the process cartridges 1 have configurations similar to configurations of those in the first embodiment, and thus descriptions thereof omitted.

The four process cartridges 1 form yellow, cyan, magenta, and black toner images on the respective photoreceptors 2. The four process cartridges 1 are arranged in parallel to the belt travel direction indicated by arrow shown in FIG. 36. The toner images formed on the respective photoreceptors 2 are transferred therefrom and superimposed sequentially one on another on the intermediate transfer belt 7 (primary-transfer process). Thus, a multicolor toner image is formed on the intermediate transfer belt 7.

As one of multiple tension rollers around which the intermediate transfer belt 7 is looped is rotated by a driving roller, the intermediate transfer belt 7 rotates in the belt travel direction indicated by arrow shown in FIG. 36. While the toner images are superimposed sequentially on the rotating intermediate transfer belt 7, the multicolor toner image is formed thereon.

Figure 37:
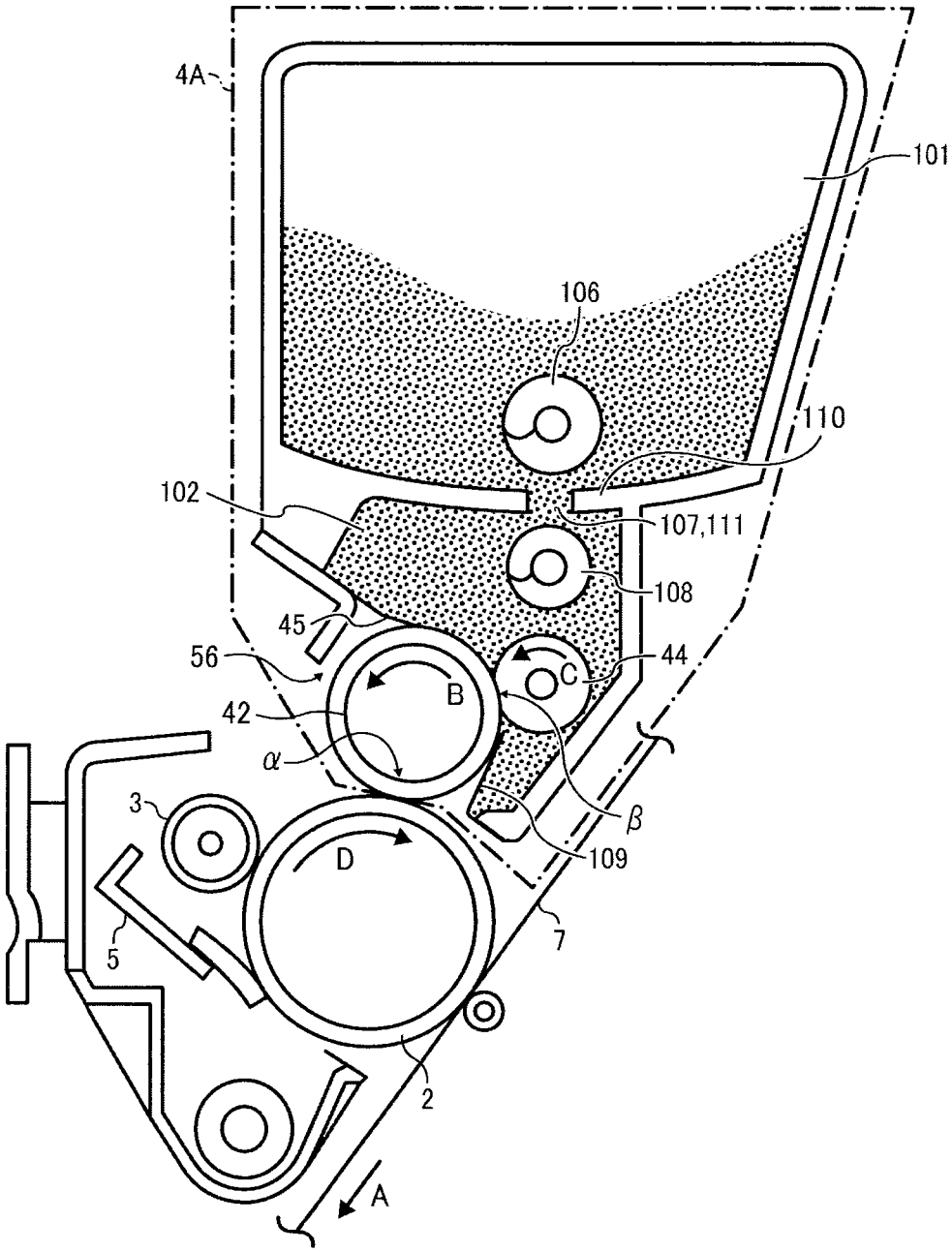
FIG. 37 is an enlarged cross-sectional view illustrating a process cartridge of the image forming apparatus shown in FIG. 36.
Figure 38:
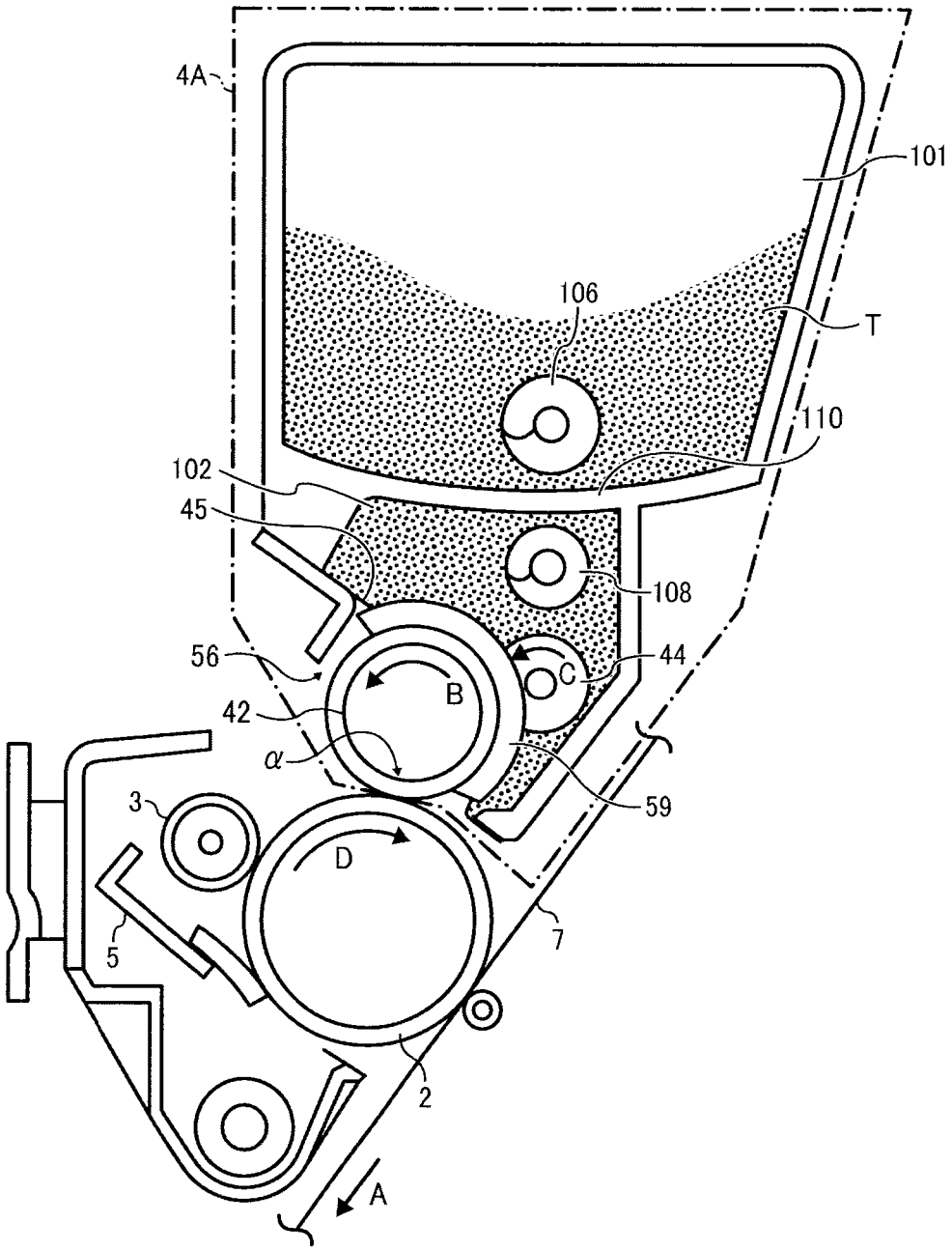
FIG. 38 is an enlarged cross-sectional view illustrating an axial end portion of the process cartridge shown in FIG. 37.
Figure 39:
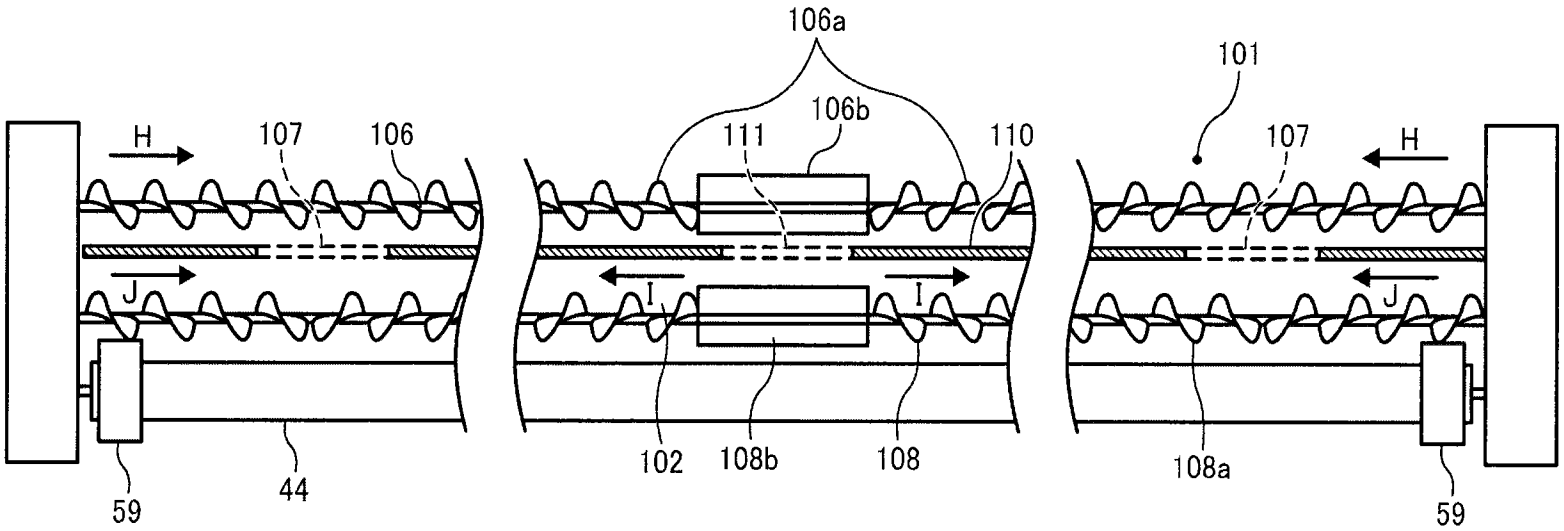
FIG. 39 is a cross-sectional view along the axial direction of a development device included in the process cartridge shown in FIG. 38.

Referring to FIGS. 37 through 39, a configuration of the development device 4A in the process cartridge 1 is described below.

FIGS. 37 and 38 are enlarged end-on axial views of one of the four process cartridges 1. FIG. 37 illustrates a center portion in the axial direction of the development roller 42, whereas FIG. 38 illustrates an end portion in that direction where a lateral end seal 59 is disposed. FIG. 39 is a cross sectional view of a conveyance member 106, an toner agitator 108, and a supply roller 44, which are arranged substantially linearly in the vertical direction.

The development device 4A includes a partition 110 that separates an interior of the development device 4A into a toner containing chamber 101 for containing toner T serving as developer and a supply compartment 102 disposed beneath the toner containing chamber 101. As shown in FIG. 39, in the partition 110, multiple openings, namely, a supply opening 111 through which toner is supplied from the toner containing chamber 101 to the supply compartment 102 and return openings 107 through which toner is returned from the supply compartment 102 to the toner containing chamber 101, are formed.

The development roller 42 serving as a developer bearer is provided beneath the supply compartment 102. The supply roller 44 provided in the supply compartment 102 serves as a developer supply member to supply toner T to the surface of the development roller 42. The supply roller 44 is disposed in contact with the surface of the development roller 42. Additionally, a doctor blade 45 serving as a developer regulator is provided in the supply compartment 102 to adjust the amount of toner supplied by the development roller 42 to the development range where the development roller 42 faces the photoreceptor 2. The doctor blade 45 is disposed in contact with the surface of the development roller 42.

The development roller 42 is contactless with the photoreceptor 2, and a high pressure power source applies a predetermined bias to the development roller 42.

The conveyance member 106 serving as a toner conveyance member is provided in the toner containing chamber 101 to transport toner T in parallel to the axial direction of the photoreceptor 2, which is perpendicular to the surface of the paper on which FIG. 37 is drawn.

In the present embodiment, toner T contained in the toner containing chamber 101 can be produced through a polymerization method. For example, toner T has an average particle diameter of 6.5 μm, a circularity of 0.98, and an angle of rest of 33°, and strontium titanate is externally added to toner T as an external additive. It is to be noted that toner usable in the image forming apparatus 600 according to the second embodiment is not limited thereto.

As shown in FIG. 39, the conveyance member 106 includes a rotary shaft, screw-shaped spiral blades 106*a*, and planar blades 106*b*. Thus, screw blades and planar blades are used in combination. The conveyance member 106 can transport toner in the toner containing chamber 101 substantially horizontally (indicated by arrow H in FIG. 39) in parallel to the rotary shaft thereof by rotation of the spiral blades 106*a*. However, the configuration of the toner conveyance member is not limited thereto. Alternatively, a belt-shaped or coil-like rotary member capable of transporting toner may be used.

Additionally, the toner conveyance member may include, a portion capable of loosening toner, such as paddles, planar blades, or a bent wire in combination with such conveyance portion.

Additionally, in the second embodiment, toner is transported from the toner containing chamber 101 toward the supply roller 44 in a direction perpendicular to the axial direction of the conveyance member 106 and substantially vertically. Alternatively, toner may be transported in a direction perpendicular to the axial direction of the conveyance member 106 and substantially horizontally.

The toner agitator 108 is disposed in the supply compartment 102 under the partition 110. As shown in FIG. 39, the toner agitator 108 includes a rotary shaft, screw-shaped spiral blades 108*a*, and planar blades 108*b*. Thus, screw agitation blades and planar agitation blades are used in combination. The toner agitator 108 can transport toner in the supply compartment 102 substantially horizontally (indicated by arrow I or J in FIG. 39) in parallel to the rotary shaft thereof by rotation of the spiral blades 108*a*.

As shown in FIG. 39, the spiral blades 108*a* of the toner agitator 108 are disposed to transport toner to both axial ends as indicated by arrow I from the supply opening 111. Additionally, in the axial direction, each spiral blade 108*a* includes a portion positioned outside the return opening 107 (hereinafter "outer portion") and a portion positioned inside the return opening 107 (hereinafter "inner portion"), which wind in the opposite directions. With this configuration, toner T supplied to the supply compartment 102 through the supply opening 111 is transported outward in the axial direction as indicated by arrow I by the inner portions of the spiral blades 108*a*. Outside the respective return openings 107, the outer portions of the spiral blades 108*a* transport toner inward as indicated by arrow J to the return openings 107. Toner positioned inside and outside the return opening 107 is thus transported in the opposite directions to the return opening 107 in the axial direction. Accordingly, toner transported from both sides in the axial direction accumulates beneath the return opening 107 and is piled up. When the amount of toner supplied to the supply compartment 102 from the toner containing chamber 101 through the supply opening 111 or the return openings 107 is excessive, toner is thus piled up and can be returned through the return openings 107 to the toner containing chamber 101. Additionally, the toner agitator 108 supplies toner to the supply roller 44 or the development roller 42 positioned beneath the toner agitator 108 while agitating toner inside the supply compartment 102.

A surface of the supply roller 44 is covered with a foamed material in which pores or cells are formed so that toner T transported to the supply compartment 102 and then agitated by the toner agitator 108 can be efficiently attracted to the surface of the supply roller 44. Further, the foamed material can alleviate the pressure in the portion in contact with the development roller 42, thus preventing or reducing deterioration of the developer T. It is to be noted that the electrical resistance value of the foamed material can be within a range from about $10^3\Omega$ to about $10^{14}\Omega$. A supply bias is applied to the supply roller 44, and the supply roller 44 promotes effects of pushing preliminarily charged toner against the development roller 42 in the supply nip β. The supply roller 44 supplies toner carried thereon to the surface of the development roller 42 while rotating counterclockwise in FIG. 37.

The doctor blade 45 is disposed to contact the surface of the development roller 42 at the position downstream from the supply nip β in the direction in which the development roller 42 rotates. As the development roller 42 rotates, the toner carried thereon is transported to the position where the doctor blade 45 contacts.

For example, the doctor blade 45 can be a metal leaf spring constructed of SUS304CSP or SUS301CSP (JIS standard); or phosphor bronze. The distal end (free end) of the doctor blade 45 can be in contact with the surface of the development roller 42 with a pressure of about 10 N/m to 100 N/m. While adjusting the amount of toner passing through the regulation nip, the doctor blade 45 applies electrical charge to toner through triboelectric charging. To promote triboelectric charging, a bias may be applied to the doctor blade 45.

The photoreceptor 2 is contactless with the development roller 42 and rotates clockwise in FIG. 37. Accordingly, the surface of the development roller 42 and that of the photoreceptor 2 move in an identical direction in the development range α.

As the development roller 42 rotates, the toner thereon is transported to the development range α, where a development field is generated by differences in electrical potential between the latent image formed on the photoreceptor 2 and the development bias applied to the development roller 42. The development field moves toner from the development roller 42 toward the photoreceptor 2, thus developing the latent image into a toner image.

A discharge seal 109 (shown in FIG. 37) is provided to a portion where toner that is not used in the development range α is returned to the supply compartment 102. The discharge seal 109 is disposed in contact with the development roller 42 and prevents leakage of toner outside the development device 4A. The discharge seal 109 receives a bias from a bias power source to enhance its discharge capability.

To generate the development field, an AC bias that alternates between a voltage to move toner toward the photoreceptor 2 and a voltage to return toner to the development roller 42 is used. In the second embodiment, for example, a rectangular wave having a frequency (f) from 500 Hz to 10000, a peak-to-peak voltage (Vpp) from 500 V to 3000 V, a duty from 50% to 90% is usable. Toner that is not used in image development is returned to the supply compartment 102 and repeatedly used as the development roller 42 rotates.

The features of the development roller 42 and the doctor blade 45 according to the first embodiment can adapt to the development device 4A according to the second embodiment.

The various configurations according to the present inventions can attain specific effects as follows.

Configuration A: A development device includes a developer bearer, such as a development roller 42, to carry by rotation magnetic or nonmagnetic one-component developer to a development range facing a latent image bearer, such as the photoreceptor 2, and to supply the developer to a latent image formed on the latent image bearer, and a planar developer regulator, such as the doctor blade 45, that includes a fixed end portion held by a regulator holder, such as the blade holder 45*c*, and a free end portion to contact a surface of the developer bearer to adjust an amount of developer carried to the development range α. The developer bearer has surface unevenness, such as the projections 42*a* and the recesses 42*b* formed in the surface thereof. The developer regulator is constructed of a metal material. With this configuration, the amount of toner can be adjusted to a desired amount with the projecting amount of the developer regulator within a range suitable for the edge contact state. The desired amount of toner can be maintained by setting the projecting amount of the developer regulator so that the edge contact state can be secured even if tolerance in installation of the developer regulator or abrasion of the developer regulator over time causes the projecting amount to vary. Therefore, in the development device including the developer bearer having surface unevenness, the desired amount of toner can be maintained on the developer bearer.

Configuration B: In configuration A, the developer regulator is disposed such that the edge portion (45*e*) on the free end side thereof contacts the surface of the developer bearer and is curved or warped. Thus, the developer regulator can dig in the surface of the developer bearer and be disposed in a warped posture. This arrangement can increase margin of tolerance in positioning or attachment of the developer regulator, thereby facilitating assembling. Further, increases in margin of mechanical tolerance can reduce component cost.

Configuration C: In configuration B, the edge portion on the free end side means a portion around a line or corner where a virtual plane extending along an opposed face (45*b*) of the developer regulator facing the developer bearer crosses a virtual plane extending along an end face (45*a*) on the free end side of the developer regulator. With this configuration, the developer regulator can level off developer on the developer bearer into a thin layer. Accordingly, the amount of developer carried thereon can be determined by the capacity of the recesses (42*b*) of the developer bearer, keeping the amount of toner substantially constant.

Configuration D: In any of configurations A through C, the portion (on the free end side) of the developer regulator that contacts the developer bearer is constructed of a material having a degree of hardness lower than that of the developer bearer. With this configuration, even if a small amount of toner adheres to a portion of the developer regulator, that can be abraded by sliding contact with the developer bearer before the adhering toner grows. Accordingly, noticeable streaky unevenness in image density is not caused.

Configuration E: In any of configurations A through D, the surface of the developer bearer is plated with nickel. Nickel plating can prevent the developer bearer against rust and charge developer to a desired polarity (negative polarity in the above-described embodiment).

Configuration F: In any of configurations A through E, the portion (on the free end side) of the developer regulator that contacts the developer bearer is constructed of phosphor bronze having a Vickers hardness of 80 Hv or lower. With this configuration, the developer regulator can be abraded by sliding contact with the developer bearer, preventing the growth of toner adhesion and streaky unevenness in image density.

Configuration G: In any of configurations A through F, in the surface of the developer bearer for carrying toner supplied to the latent image bearer, at any position in the width direction perpendicular to the direction of rotation of the developer bearer, at least a single highest portion, such as top face 42*t*, in the surface unevenness is present while the developer bearer makes one rotation. With this arrangement, while the developer bearer makes one rotation, any axial position over the axial length of the developer regulator can contact the top portion on the surface of the developer bearer at least once and be abraded efficiently. Thus, streaky image density unevenness resulting from toner adhesion can be prevented securely.

Configuration H: In configuration G, the projections (42*a*) and the recesses (42*b*) formed in the surface of the developer bearer are cyclically arranged in the width direction at a given circumferential position (such as line L11 shown in FIG. 13), and at a adjacent circumferential position (such as line L12) in the circumferential direction, the cyclic arrangement of the projections and the recesses is shifted by a half cycle of this arrangement. This configuration can secure prevention of streaky image density unevenness resulting from toner adhesion.

Configuration I: In any of configurations A through H, the developer bearer is disposed facing, but is contactless with, the latent image bearer across a predetermined gap in the development range α, and the development device further includes a development bias applicator, such as the development bias power source 142, to apply an alternating voltage to the developer bearer. This arrangement can prevent absence of developer in output images regardless of accuracy in relative positions of the developer bearer and the latent image bearer.

Configuration J: The above-described development device according to any of the configurations A through I is incorporated in an image forming apparatus that includes at least the latent image bearer, a charging member, and a latent image forming device such as the exposure unit 6. With this configuration, a desired amount of developer can be reliably carried on the developer bearer, and image density can be stable.

Configuration K: In configuration J, the development device and at least one of the latent image bearer, the charging member, and a drum cleaning unit are housed in a common unit casing, forming a modular unit or process cartridge removably installed in a body of the image forming apparatus. With this configuration, the development device capable of attaining stable image density can be removed together with the component of the process cartridge, and replacement of the development device can be facilitated.

Configuration L: In configuration J or K, further an alert device to alert the user to the replacement timing of the development device is provided. Additionally, replacement timing is predetermined so that the end face of the developer regulator remains at the time of replacement of the development device. This configuration can inhibit deviation of the contact position between the developer regulator and the developer bearer and damage to the developer bearer given by the sharpened edge of the developer regulator.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer bearer to carry by rotation, one-component developer to a development range facing a latent image bearer, the developer bearer including a developer carrying range having surface unevenness; and a planar metal developer regulator including a fixed end portion held by a regulator holder and a free end portion, metal of the planar metal developer regulator is to contact a surface of the developer bearer to adjust an amount of one-component developer carried to the development range, wherein:

the free end portion of the developer regulator is constructed of a material having a degree of hardness lower than a degree of hardness of the developer bearer, an edge portion on a free end side of the developer regulator contacts the surface of the developer bearer, the developer regulator further comprises an opposed face facing the developer bearer and an end face on the free end side, the edge portion on the free end side that contacts the surface of the developer bearer is adjacent to a line formed by a virtual plane extending along the opposed face and a virtual plane extending along the end face on the free end side, the edge portion on the free end side that contacts the surface of the developer bearer is disposed in an upstream orientation relative to a direction of rotation of the developer bearer, and the edge portion on the free end side is a furthest position on the free end side of the opposed face from the fixed end portion of the developer regulator.

2. The development device according to claim 1, wherein the free end portion of the developer regulator is constructed of a metal material having a Vickers hardness of 80 Hv or lower.

3. The development device according to claim 1, wherein the surface of the developer bearer is plated with nickel.

4. The development device according to claim 1, wherein, inside the developer carrying range of the developer bearer, at any position in a width direction perpendicular to the direction of rotation of the developer bearer, at least a single highest portion in the surface unevenness is present while the developer bearer makes one rotation.

5. The development device according to claim 4, wherein the surface unevenness of the developer bearer is formed by multiple projections and multiple recesses arranged cyclically in lines extending in the width direction, and an arrangement cycle of the multiple projections and the multiple recesses is shifted by a half cycle between two lines adjacent to each other in the direction of rotation of the developer bearer.

6. The development device according to claim 1, further comprising a development bias applicator to apply an alternating voltage to the developer bearer, wherein the developer bearer is disposed contactlessly with the latent image bearer across a predetermined gap in the development range.

7. An image forming apparatus comprising:

a latent image bearer;

a charging member to charge a surface of the latent image bearer uniformly;

a latent image forming device to form a latent image on the latent image bearer; and a development device to develop the latent image with one-component developer, the development device comprising:

a developer bearer to carry by rotation, developer to a development range facing the latent image bearer, the developer bearer including a developer carrying range having surface unevenness; and a planar metal developer regulator including a fixed end portion held by a regulator holder and a free end portion, metal of the planar metal developer regulator is to contact a surface of the developer bearer to adjust an amount of one-component developer carried to the development range, wherein the free end portion of the developer regulator is constructed of a material having a degree of hardness lower than a degree of hardness of the developer bearer, wherein the developer regulator further comprises an opposed face facing the developer bearer and an end face on the free end side, the edge portion on the free end side that contacts the surface of the developer bearer is adjacent to a line formed by a virtual plane extending along the opposed face and a virtual plane extending along the end face on the free end side, the edge portion on the tree end side that contacts the surface of the developer bearer is disposed in an upstream orientation relative to a direction of rotation of the developer bearer, and the edge portion on the free end side is a furthest position on the free end side of the opposed face from the fixed end portion of the developer regulator.

8. The image forming apparatus according to claim 7, further comprising a cleaning unit to clean the surface of the latent image bearer, wherein the development device and at least one of the latent image bearer, the charging member, and the cleaning unit are housed in a common unit casing, forming a modular unit or process cartridge removably installed in a body of the image forming apparatus.

9. The image forming apparatus according to claim 7, further comprising an alert device to alert a user to replace the development device, wherein the developer regulator further comprises an opposed face facing the developer bearer and an end face on the free end side, and a replacement timing of the development device is predetermined so that the end face of the developer regulator remains at the time of replacement of the development device.

10. A development device comprising:

a developer bearer to carry by rotation, one-component developer to a development range facing a latent image bearer, the developer bearer including a developer carrying range having surface unevenness, the developer bearer including metal; and a planar metal developer regulator including a fixed end portion held by a regulator holder and a free end portion, metal of the planar metal developer regulator is to contact a surface of the developer bearer to adjust an amount of one-component developer carried to the development range, wherein an edge portion on a free end side of the developer regulator contacts the surface of the developer bearer, wherein the developer regulator further comprises an opposed face facing the developer bearer and an end face on the free end side, the edge portion on the free end side that contacts the surface of the developer bearer is adjacent to a line formed by a virtual plane extending along the opposed face and a virtual plane extending along the end face on the free end side, the edge portion on the free end side that contacts the surface of the developer bearer is disposed in an upstream orientation relative to a direction of rotation of the developer bearer, and the edge portion on the free end side is a furthest position on the free end side of the opposed face from the fixed end portion of the developer regulator; wherein the free end portion of the developer regulator is constructed of a material having a degree of hardness lower than a degree of hardness of the developer bearer.

11. The development device according to claim 10, wherein the free end portion of the developer regulator is constructed of a metal material having a Vickers hardness of 80 Hv or lower.

12. The development device according to claim 10, wherein the surface of the developer bearer is plated with nickel.

13. The development device according to claim 10, wherein, inside the developer carrying range of the developer bearer, at any position in a width direction perpendicular to the direction of rotation of the developer bearer, at least a single highest portion in the surface unevenness is present while the developer bearer makes one rotation.

14. The development device according to claim 13, wherein the surface unevenness of the developer bearer is formed by multiple projections and multiple recesses arranged cyclically in lines extending in the width direction, and an arrangement cycle of the multiple projections and the multiple recesses is shifted by a half cycle between two lines adjacent to each other in the direction of rotation of the developer bearer.

15. The development device according to claim 10, further comprising a development bias applicator to apply an alternating voltage to the developer bearer, wherein the developer bearer is disposed contactlessly with the latent image bearer across a predetermined gap in the development range.

* * * * *